US005372370A

United States Patent [19]

Rohrmoser

[11] Patent Number: 5,372,370

[45] Date of Patent: Dec. 13, 1994

[54] LAMINATED SKI WITH INTEGRATED TOP STRAP AND PROCESS OF MANUFACTURE

[75] Inventor: Alois Rohrmoser, Wargrain, Austria

[73] Assignee: Atomic Skifabrik Alois Rohrmoser, Wagrain, Austria

[21] Appl. No.: 92,242

[22] Filed: Jul. 14, 1993

[30] Foreign Application Priority Data

Jul. 16, 1992 [AT] Austria ..... A 1464/92
Feb. 25, 1993 [AT] Austria ..... A 362/93

[51] Int. Cl.[5] ..... A63C 5/14
[52] U.S. Cl. ..... 280/610; 280/602
[58] Field of Search ..... 280/610, 609, 602, 607, 280/608; 264/46.5, 46.6

[56] References Cited

U.S. PATENT DOCUMENTS

| | | | |
|---|---|---|---|
| 3,498,626 | 3/1970 | Sullivan | 280/610 |
| 4,416,929 | 11/1983 | Krueger | 280/610 X |
| 4,671,529 | 6/1987 | LeGrand et al. | 280/610 |
| 4,993,740 | 2/1991 | Recher et al. | 280/610 |
| 5,000,475 | 3/1991 | Gagneux et al. | 280/610 |
| 5,002,300 | 3/1991 | Pascal et al. | 280/610 X |
| 5,160,158 | 11/1992 | Scherubl | 280/610 |
| 5,173,226 | 12/1992 | Cazaillon et al. | 264/46.6 |
| 5,186,777 | 2/1993 | Perenon et al. | 264/46.5 X |

FOREIGN PATENT DOCUMENTS

| | | | |
|---|---|---|---|
| 0336460 | 8/1976 | Austria . | |
| 0377440 | 8/1984 | Austria . | |
| 0428886 | 5/1991 | European Pat. Off. | 280/610 |
| 0430824 | 6/1991 | European Pat. Off. | 280/610 |
| 1423868 | 11/1965 | France . | |
| 2606655 | 5/1988 | France | 280/610 |
| 2033845A1 | 1/1972 | Germany . | |
| 3302770 | 8/1983 | Germany . | |
| 3738040 | 8/1988 | Germany . | |
| 0273005 | 11/1989 | Germany . | |
| 3822900 | 1/1990 | Germany . | |
| 4106911A1 | 9/1991 | Germany | 280/610 |
| 4114038 | 2/1992 | Germany . | |
| 0668743 | 1/1989 | Switzerland . | |

*Primary Examiner*—Richard M. Camby
*Assistant Examiner*—Peter C. English
*Attorney, Agent, or Firm*—Collard & Roe

[57] ABSTRACT

A ski comprises a laminated top strap integrated in a U-shaped shell, a bottom strap including a running surface layer and at least one additional reinforcement layer, and running edges along the two sides of the running surface layer and abutting free ends of the shanks of the U-shaped shell along a longitudinally extending line running in a horizontal plane of contact between the running edges and shank ends. The shell and the bottom strap define an inner hollow space and a ski core is arranged in this space. Support elements are arranged on the upper and lower core sides, the support elements defining longitudinally and transversely extending recesses therebetween and between the upper and lower core sides and the top and bottom straps. These recesses communicate with intermediate hollow spaces defined between the side walls of the ski core and the shanks of the U-shaped shell, and these intermediate hollow spaces include a chamber extending along the ski, projecting outwardly and continuously tapering towards an outer face of the running edge and ending at the longitudinally extending line. Intermediate layers are arranged between the base of the U-shaped shell and the core, and a plastic material fills the recesses and the intermediate hollow spaces including the continuously tapering chambers, the plastic material being bonded to the shell, the core, the top strap and the bottom strap.

28 Claims, 12 Drawing Sheets

Fig. 5
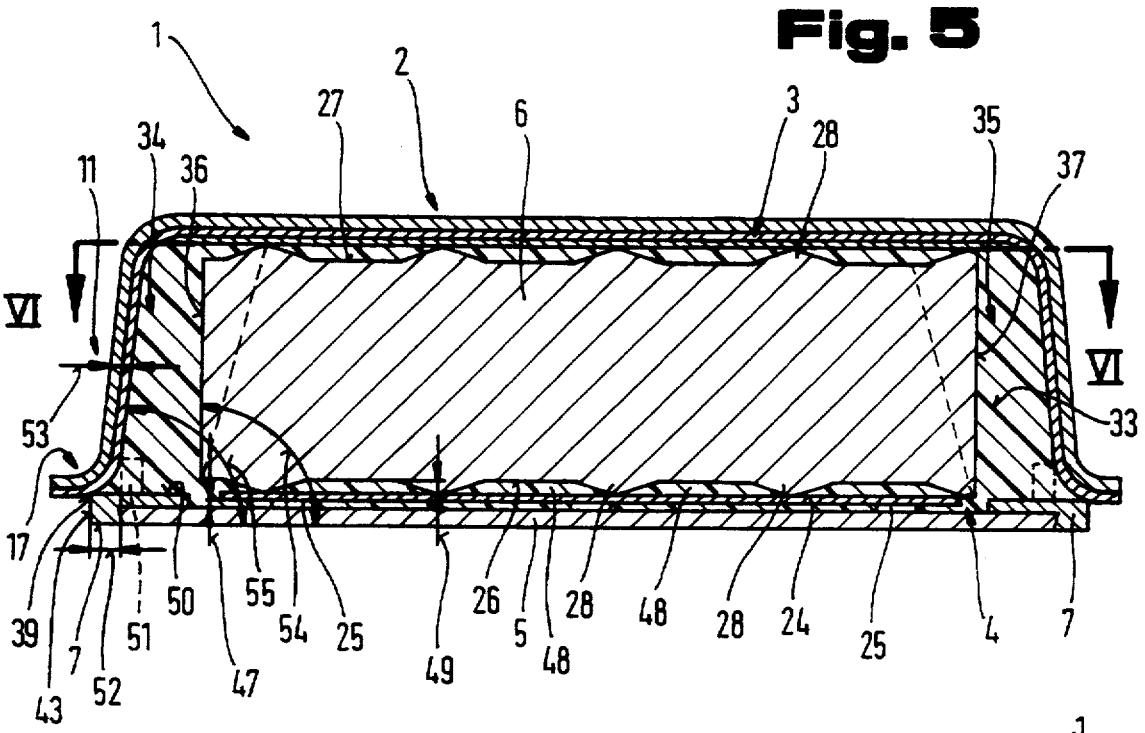
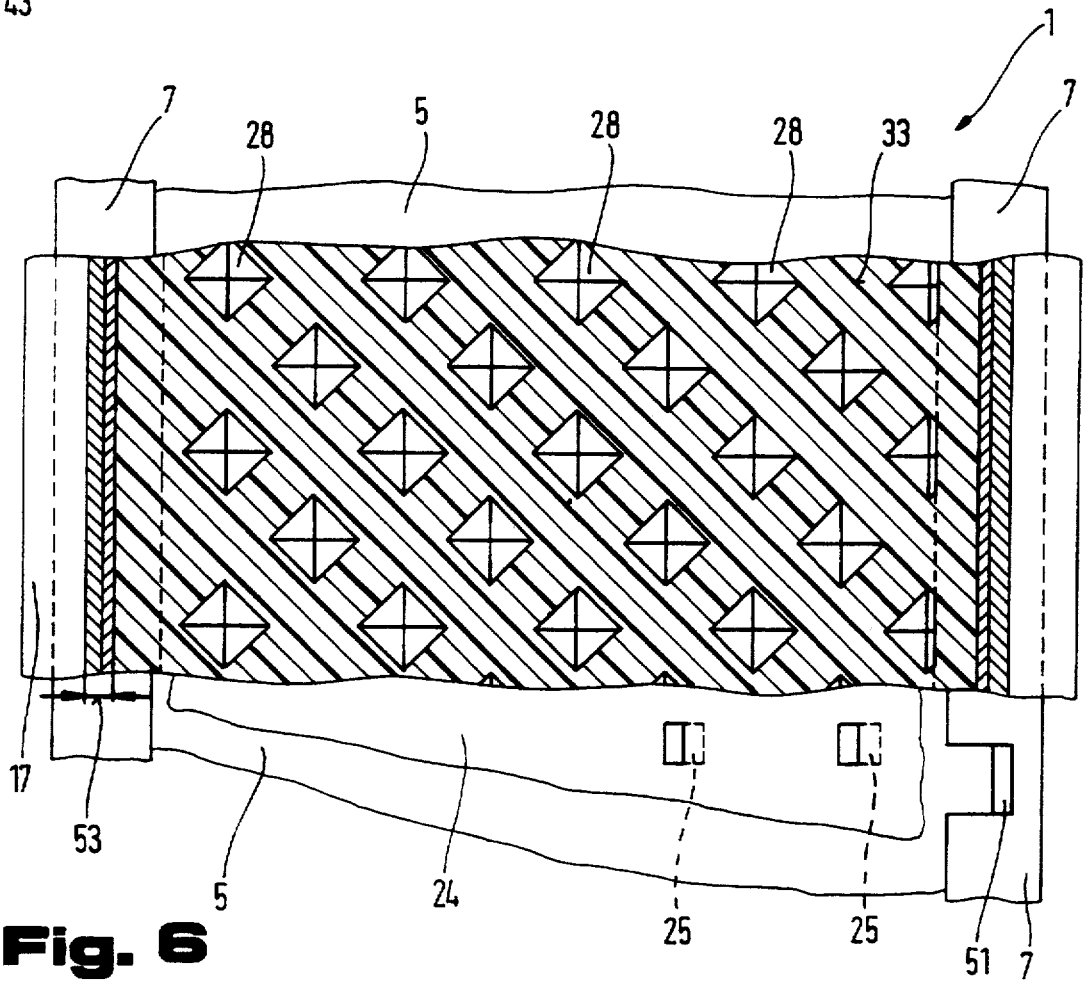
Fig. 6

LAMINATED SKI WITH INTEGRATED TOP STRAP AND PROCESS OF MANUFACTURE

BACKGROUND OF THE INVENTION

1. Field of the Invention

The present invention relates to a ski with an integrated top strap and a process for the manufacture thereof.

2. The Prior Art

U.S. Pat. No. 5,160,158 discloses a ski with a top strap and a bottom strap. A core is located between these straps and is connected with the plies of the top and bottom strap by means of an adhesive layer, which consists of the same plastic material, in particular plastic foam, as the side faces on both sides of the core. The surfaces of the core and the surfaces of the top and bottom strap facing towards said core are provided with cavities to receive the plastic foam that forms the adhesive layer. Such a ski can be produced in a cost-effective manner, but, due to extreme stresses caused by the elastic properties of the plastic foam, which also forms the pair of side faces, the side faces may be destroyed prematurely.

Furthermore, from German Patent DE-A1-20 33 845 it is known to produce a ski with a shell having an approximately U-shaped cross section, the shanks of which, in order to close an inner hollow space, are provided with a plate forming a parallel plane to the running surface layer. The intermediate spaces between a core inserted in the inner hollow space, and in particular the shanks of the U-shaped shell, are filled with a plastic material, in particular a plastic foam. For perfect production of the outer surfaces of the ski, high demands are being made on the molds required for the production of the side faces.

Furthermore, it is disclosed in U.S. Pat. No. 5,000,475 that in the inner hollow space of a ski consisting of a shell and a cover plate forming the running surface, a core is inserted and that the intermediate spaces between the core and the shanks of the U-shaped cross section of the shell are filled with an elastically deformable, in particular damping, plastic material. The disadvantage of this known embodiment of a ski is that the bonding materials between the surfaces of the core and the base of the shell or the running surface layer or the bottom strap must be produced independently from the production or the filling of the intermediate spaces. This causes different bonding properties which lead to inner stresses inside the ski or to a delamination of said ski.

SUMMARY OF THE INVENTION

The object of the present invention is to create a ski with highly stressable side faces, which, however, provides sufficient damping of blows affecting the ski in the region of the side edges. In addition, the shell having an integrated top strap can be easily further processed and provides good dimensional stability.

The object of the invention is achieved with a ski comprising a top strap comprising more than one layer and integrated in a shell of substantially U-shaped cross section, the shell comprising a cover layer and a reinforcement layer, and the shell having a base forming the surface of the ski and shanks extending downwardly from the base and inclined at an angle with respect thereof, the shanks forming the side faces of the ski, the shanks having ends remote from the base, and a bottom strap comprising a running surface layer and at least one additional reinforcement layer, running edges extending longitudinally along the two sides of the running surface layer, each running edge abutting the end of a respective one of the shanks along a longitudinally extending line running in a horizontal plane of contact between the running edge and the shank end, and the shell and the bottom strap defining an inner hollow space. A ski core is arranged in the hollow space, the ski core having an upper side facing the top strap, a lower side facing the bottom strap and side walls spaced from the shanks to define intermediate hollow spaces between the side walls and the inner surfaces of the shell shanks, the intermediate hollow spaces each including a chamber extending in the longitudinal direction of the ski, projecting outwardly and continuously tapering towards an outer face of the running edge and ending at the longitudinally extending line. Support elements are arranged on the upper and lower core sides, the support elements defining longitudinally and transversely extending recesses therebetween and between the upper and lower core sides and the top and bottom straps, the recesses communicating with the intermediate hollow spaces and the chambers thereof, intermediate layers are arranged between the base of the shell and the core, and a plastic material fills the recesses and the intermediate hollow spaces including the continuously tapering chambers, the plastic material being bonded to the shell, the core, the top strap and the bottom strap. By using a uniform bonding material between the core and the shell, that is, the bottom strap or running surface layer, a uniform deformation can be achieved at different stress levels, if desired, with simultaneous damping of the deformation movement. This improves the structure of a tension-neutral ski and makes it possible to produce a ski with less temperature stress on the individual components.

The plastic material is preferably an elastomer foam, and the longitudinally extending line is advantageously defined by the intersection of a vertical plane defining the outer face of the running edge and the horizontal plane in contact with the end of the shank. This establishes, without any additional inserts, a frictional connection achieved by means of the plastic material injected between the shell and the running edge.

In an embodiment, the longitudinally extending line is spaced from a vertical plane defining the outer face of the running edge either outwardly or inwardly. In this way, the stiffness of the ski in the region of the running edge can be modified in a simple way because if the limiting line lies outside the outer surface of the running edge, a shock absorber or vibration damper is created without any additional inserts or components through adequate adjustment of the elasticity of the plastic material which fills the intermediate space.

An embodiment which uses the intermediate space to connect the shell and the ski core, thus achieving a modification of the damping properties of the ski without any change in its overall structure, provides that a respective one of the intermediate hollow spaces has a volume increasing with an increase in the desired damping of ski deformations due to blows against the running edge at said intermediate hollow space.

A further embodiment provides that one of the intermediate hollow spaces has a smaller volume than the other intermediate hollow space, the one intermediate hollow space facing another ski of a pair of skis used together. This is advantageous because only by modification of the intermediate space, a higher flexibility of the outside edge of the ski can be achieved, thus balancing out any running faults of the user of such a ski, whereas at the inner edge of the ski, i.e. the running edge facing towards the other ski, high stiffness and thereby better guiding of the ski can be achieved.

If the intermediate hollow spaces have a cross-sectional area varying in the longitudinal direction of the ski in proportion to the cross-sectional area of the ski or the core, different elastic properties can be achieved over the whole length of the ski simply by modifying the intermediate space and thus providing an easier construction of a ski according to the invention.

If the cross-sectional area of the intermediate hollow spaces is smaller in the central region than at the ends of the ski, an increasing elasticity in the direction of the leading and the rear end of the ski can be achieved, also a softer shovel of the ski may be produced easier, for example.

An embodiment wherein the side walls of the core enclose an angle with the bottom strap which decreases from the central region to the ends of the ski is also advantageous because only differently formed cores must be stored for skis being used for different purposes and with different flexibility properties, whereas all other components of the ski can be used without being modified.

Great strength of the ski in the assembly region of the binding and good tear-out resistance of the ski binding is provided if the angle between the running surface layer and the side walls of the core remain constant in the central region of the ski where the binding is mounted.

If the side walls of the core and the shanks of the shell extend substantially parallel to each other, uniform elastic deformation behavior can be achieved in the region of the side faces over the whole thickness of the ski.

The shanks of the shell may be oriented at a larger inner angle with respect to the base of the shell than at least one of the side walls of the core for stronger, elastic damping in the region next to the running edge without any effect on the utilization rigidity of the ski. The larger inner angle is preferably between 70° and 130°, advantageously more than 90°, and the smaller inner angle is 90°.

The intermediate space regions are more stable under stress if at least one of the side walls of the core has projections defining depressions therebetween. The projections may increase in height from the center region towards the ends.

It is also advantageous if, during the production of the shell, at least one of the shanks of the shell is provided with projections on the inside thereof and defining depressions therebetween, which projections may increase in height from the center region towards the ends. These projections can be produced in a single operation through appropriate forming, and no mechanical treatment of the ski core is required.

Due to the advantageous variation in the height of the projections, the thickness of the elastic plastic material layer can be quickly modified, and the deformation behavior of the ski can be easily adapted to different requirements.

If a ski is formed with support elements or projections increasing in height the farther they are removed from the central ski regions, vibrations or blows affecting the ski on the ski binding can be more strongly damped.

With a preferred embodiment wherein the support elements are arrayed on the upper side of the core only alongside the side walls of the core in the central region, leaving a central area of the upper core side free of support elements, an anchoring plate spans the central area of the upper core side, a ski binding is mounted on the surface of the ski, and fastening elements in the region of the side walls of the core connect the ski binding to the anchoring plate, a free floating mounting of the ski binding can be achieved, at least in the perpendicular direction of the running surface of the ski or when the through-holes in the cover ply for the fastening means have an adequate size, also in all directions in space.

An anchoring plate made of spring steel provides a greater damping effect with a free floating mounted ski binding.

If spaces between the central area of the upper core side and the anchoring plate and the anchoring plate and the top strap are filled with a plastic material of a hardness less than the hardness of the plastic material filling the intermediate hollow spaces, the maximum oscillating movement or range of movement of the mounting insert can be adapted to different types of skis or to different purposes and especially to different temperatures during use. By using an appropriate plastics gel, it is possible in a preferred further embodiment, depending on what the ski is used for, to modify the damping properties. If, for example, there is a lot of vibration or deformation of the ski and the gel is, therefore, heated, higher elasticity can be achieved or vice versa. The plastic material of less hardness preferably forms a gel whose hardness varies under the influence of energy and temperature changes.

It is also advantageous if the plastic material filling the intermediate hollow spaces is a two-component polyurethane elastomer foam. By using a two-component material, the physical properties of the used plastic material can be very well adapted to the different conditions of use. Moreover, an exact reproduction of the desired properties can be achieved by using a two-component material because it is not dependent on the chemical reaction caused by outside influences.

It is advantageous to use a plastic material with a density between 0.5 and 1.5 kg/dm$^3$, preferably between 0.9 and 1.1 kg/dm$^3$, since the density of the plastic material allows for sufficient strength of the connection between the individual plies of the ski structure as well as of the shell.

If the plastic material has a Shore D hardness between 65 and 90, preferably 72 to 78, the bonding layer between the individual plies of the ski and the shell provides at the same time a further important function of a ski, namely the damping of blows and deformations. Furthermore, the bonding material achieves that no additional damping plies are necessary and the whole assembly of the ski is, therefore, simplified.

Skis which are very much stressed, in particular racing skis, can have a bottom strap with a reinforcement layer, for example of aluminum, a titanium-aluminum alloy, fiberglass, carbon, ceramic or steel sheet, with spacers keeping a distance between the running surface layer and the reinforcement layer. This provides a solid reinforcement in the area of the running surface of the ski.

If projections extend from the running edges towards the top strap, the projections being spaced inwardly from the outer faces of the running edges by a distance corresponding at least to the thickness of the shanks of the shell, the connection of the running edges can also be made in a single operation by using the plastic material that fills the intermediate space.

If a reinforcement layer comprised of a prepeg, for example, is used in the shell, materials which are not inherently rigid can be used for the cover ply or any damage done to the prefabricated, reinforced cover plies during storage before the ski has been finished can be avoided. Furthermore, this makes it also possible to produce the required hollow spaces for the plastic material which makes up the connection between the shell and the ski core or the other parts of the ski during the formation of the shell by forming appropriate supporting elements at the same time.

It is possible to reinforce the ski in the bottom strap area, that is to say in the opposite direction of its main stresses caused by bending if the ski further comprises a sandwich structure comprised of a laminate, an aluminum layer and another laminate arranged between the running surface layer and the core, and further comprises a spacing insert therebetween, the spacing insert having a thickness corresponding to the thickness of an inwardly extending flange of the running edges.

The reinforcement layer of the shell is preferably comprised of at least one pre-impregnated fiber reinforced ply, the fibers intersecting each other and extending obliquely with respect to a longitudinal axis of the shell base. The surprising advantage of this solution derives from the fact that by using a reinforcement layer of which the threads or fibers are arranged in such a way that they cross each other and are diagonal to a longitudinal axis of the surface of the shell, not only a reinforcement of the surface in different directions is achieved but also a stiffening in space of the shell. This spatial stiffening causes in particular an exact positioning and support of the shanks which form the side faces of the ski and thus a dimensionally stable formation of the shell even without the insertion of any further elements therein such as the core, for example, further intermediate layers, etc. This way, the prefabricated shells can be stored maintaining good dimensional stability and in particular they can be piled up without being distorted. This simplifies subsequent processing, namely the insertion of the core and the application of further reinforcement layers and the running surface layer since deformations are avoided when the shell is inserted into a mold fur further processing or finishing of the ski. Another advantage derives from the fact that the embodiment of this reinforcement layer influences also advantageously the stiffness of the ski against torsion after it has been finished and based on this increased stiffness against corrosion, it leads to better guiding of the ski, in particular on rough ski-runs, especially when racing during a slalom. Furthermore, the threads or fibers running diagonally to the longitudinal axis of the ski act as tension bands when the ski is bent through in the direction of the load. These bands transfer the loads to the shanks forming the side faces, which, due to their higher stress resistance, are damping the bending even further.

The reinforcement layer may consist of a mesh, a fabric or a tissue of one or a plurality of plies, and the fibers are of a tension-resistant material. The intersecting fibers may enclose angles which differ from ply to ply. This is also advantageous because the deformation resistance of the shell can be easily adapted when using different types of skis due to the spatial arrangement of threads or fibers and/or their varying composition or the use of different materials in the production of such threads or fibers.

The advantage of using a reinforcement layer consisting of unwoven fabric, in particular made from needled fibers of tension-resistant material, for instance of metal, glass, ceramic or carbon, derives from the fact that the bonding material between the shell and the reinforcement layer can penetrate more intensively into the reinforcement layer or envelop the entire surface of the individual fibers or threads, which achieves high tear-out strength at little weight in space. In addition, the entanglement of fibers or threads forming a nonwoven fabric achieves a stiffening in all desired directions in space.

If the reinforcement layer consists of a plurality of plies and the intersecting fibers are arranged at a different angle with respect to the longitudinal axis of the shell, for example enclosing angles between 45° and 90°, it is possible to solidify the shell in directions in space that can be precisely determined in advance. This achieves an adaptation of the reinforcement layer to the spatial form of the ski in a simple way and enables the tensile or pretensional forces to act in different directions or at varying distances from the ski core or the surface of the shell.

If the fibers are all made of the same material, the entire surface of the reinforcement layer shows uniform strength and expansion ratios.

If the fibers are made of different materials, a simple adaptation of the desired expansion, bending and stress-resistant properties can be achieved if the reinforcement layer is selected and composed of fibers or threads which consist of different materials.

If the fibers are arranged in bundles and are made of different materials, an even distribution of the properties, that are due to the use of different fiber and thread materials, over the whole length of the ski is achieved.

If the reinforcement layer extending over the base and shanks of the shell is of a single piece, a uniform stiffening of the shell in the region of its surface as well as in the region of the side faces of the shell is achieved.

Another embodiment combines the fibers in fiber groups, the fibers of the groups being made of different materials, whereby, besides the varying properties of the fibers or threads, their embedding in the bonding agent can also be influenced because of the different distances between the fibers or threads in the thread groups.

An appropriately highly stressable inner solidification of the reinforcement layer is made possible if the fiber-reinforced ply is pre-impregnated with a temperature and pressure-sensitive bonding agent which is non-adhesive at room temperature, since operational expenditure can be kept at a low level by using fibers or threads that have been coated with the bonding material.

Furthermore, the invention comprises also a method for the production of a ski comprising a top strap integrated in a shell of a substantially U-shaped cross section layer, the shell having a base forming the surface of the ski and shanks extending downwardly from the base and inclined at an angle with respect thereof, the shanks forming the side faces of the ski and having outwardly projecting ends remote from the base, and the base and shanks defining a hollow space. The manufacturing process comprises the steps of placing a ski core in the hollow space, the ski core having an upper side facing the base, a lower side and side walls spaced from the shanks to define intermediate hollow spaces between the side walls and the inner surfaces of the shell shanks, the intermediate hollow spaces each including a chamber extending in the longitudinal direction of the ski, projecting outwardly and continuously tapering towards the outwardly projecting shanks end, arranging support elements on the upper and lower core sides, the support element defining longitudinally and transversely extending recesses therebetween and communicating with the intermediate hollow spaces and the chambers thereof, placing a bottom strap on the outwardly projecting ends of the core shanks and over the hollow space and the intermediate hollow spaces, the bottom strap comprising a running surface layer and at least one additional reinforcement layer, and the recesses extending respectively between the upper core side and the top strap and the lower core side and the bottom strap, filling the recesses and the intermediate hollow spaces including the continuously tapering chambers with a liquid plastic material, and bonding the core, the top strap and the bottom strap to the plastic material filling.

The advantage of this arrangement lies in the fact that the ski can be assembled with few individual parts and in particular the individual parts that make up the ski can be positioned into the prefabricated shell. After all individual parts have been inserted, the mold for the ski is being closed and the plastic material for connection injected into the remaining hollow spaces.

Skis with different characteristics and different inner structures can be produced if the plastic material is an elastomer plastic foam material, the material is expanded under the influence of an elevated temperature and pressure to bond the core, the top strap and the bottom strap to the expanded plastic foam material, and if the shell is first formed by laminating a flat reinforcement layer comprised of a fiber reinforced ply impregnated with a hardenable plastic to a flat plastic cover layer, the plastic being non-adhesive at room temperature and being heated to a temperature at which it becomes adhesive for laminating the reinforcement layer to the cover layer to form a laminate, the laminate is deformed to form the U-shaped shell, and the deformed laminate is cooled to retain the deformed U-shaped form.

Advantageously, the hardenable plastic is first heated to a lower reaction temperature sufficient to make it adhesive and to laminate the reinforcement layer to the cover layer, cooled to a temperature below the lower reaction temperature to make the laminate form-stable, the laminate is subsequently heated to a higher reaction temperature sufficient to make it adhesive to bond the laminate to the ski core, and cooled to a temperature at which the plastic is in a thermoset state. The advantages of the synthetic resin, which at different temperatures allows twice for an adhesive effect to take place, lies in the fact that in addition to the remaining adhesive force of the plastic material that fills the hollow and intermediate spaces, further reaction and additional adhesive properties of the reinforcement layer can moreover increase the connecting force or strength.

If the higher reaction temperature is no higher than the elevated temperature applied to expand the elastomer plastic foam material, the additional adhesive effect is caused only by the reaction temperature of the injected plastic material without further energy requirements.

It is also advantageous if the synthetic resin with which the reinforcement layer is pre-impregnated as a bonding agent consists of EP or UP resins or polydiallylphthate since the adhesive properties are only effective at temperatures above room temperature, whereas at room temperature no sticking or adhesive effect is taking place.

The process may advantageously comprise the steps of pre-fabricating the bottom strap by bonding the running surface layer to at least one additional reinforcement layer and arranging running edges extending longitudinally along the two sides of the running surface layer, each running edge abutting the outwardly projecting end of a respective one of the shanks, placing the shell and the pre-fabricated bottom strap in a ski-shaping mold, pressing the running edges tightly against the outwardly projecting ends of the core shanks when the bottom strap is placed over the hollow space and the intermediate hollow spaces in the mold, injecting the liquid plastic material through orifices in the shell to fill the recesses and the intermediate hollow spaces including the continuously tapering chambers with the liquid plastic material, cooling the mold until the injected plastic material is solidified to bond the core, the top strap and the bottom strap to the plastic material, removing the ski shaped in the mold from the mold, and removing the outwardly projecting ends of the core shanks to make them flush with outer faces of the running edges. In this way, the final processing or production of the ski can be done with two components only. By virtue of the different structure of the plies which are connected with the ski core, it is, therefore, possible to produce a ski in a simple way. Furthermore, this ensures that a simple control of the strength properties of the main components, such as of the ski core and the adjacent plies, can be carried out before the ski is finished.

BRIEF DESCRIPTION OF THE DRAWINGS

The invention will now be described further in connection with certain now preferred embodiments, by way of example only, with reference to the accompanying drawings, in which:

FIG. 5 is a sectional front view of another embodiment of a ski in accordance with the invention;

FIG. 6 is a top view of a ski according to FIG. 5, in a section taken along the lines VI—VI in FIG. 5;

DETAILED DESCRIPTION OF PREFERRED EMBODIMENTS

Figure 1:
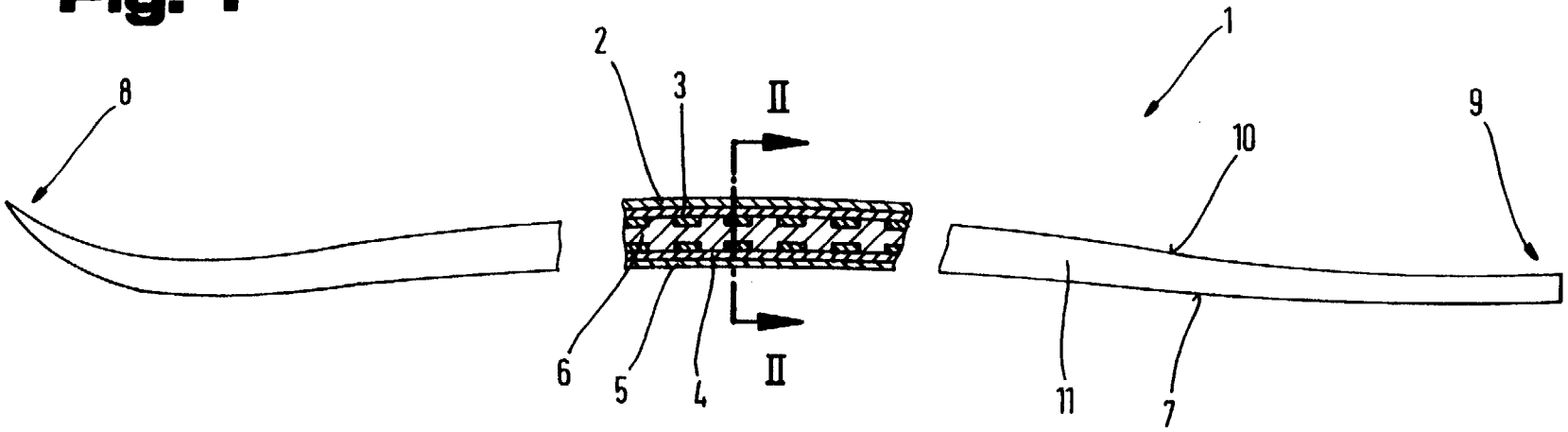
FIG. 1 is a partly sectional side view of a ski formed in accordance with the invention.

FIG. 1 shows a ski 1 that consists of a shell 2, a top strap 3, a bottom strap 4 and a running surface layer 5. Ski core 6 is arranged between top strap 3 and bottom strap 4. Running surface layer 5 is provided with running edges 7 in the region of the longitudinal side edges.

Shell 2 of ski 1 extends fully from the leading end of ski 8 to the rear end of ski 9 and forms a surface 10 and a pair of side faces 11.

Figure 4:
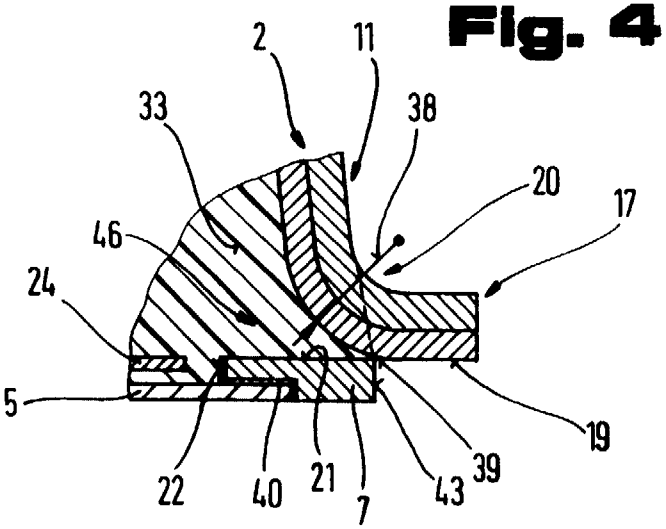
FIG. 4 shows the transition area between the bottom strap and the shell of the ski according to FIGS. 1 to 3 on a larger scale and unproportional, according to arrow IV in FIG. 2.
Figure 2:
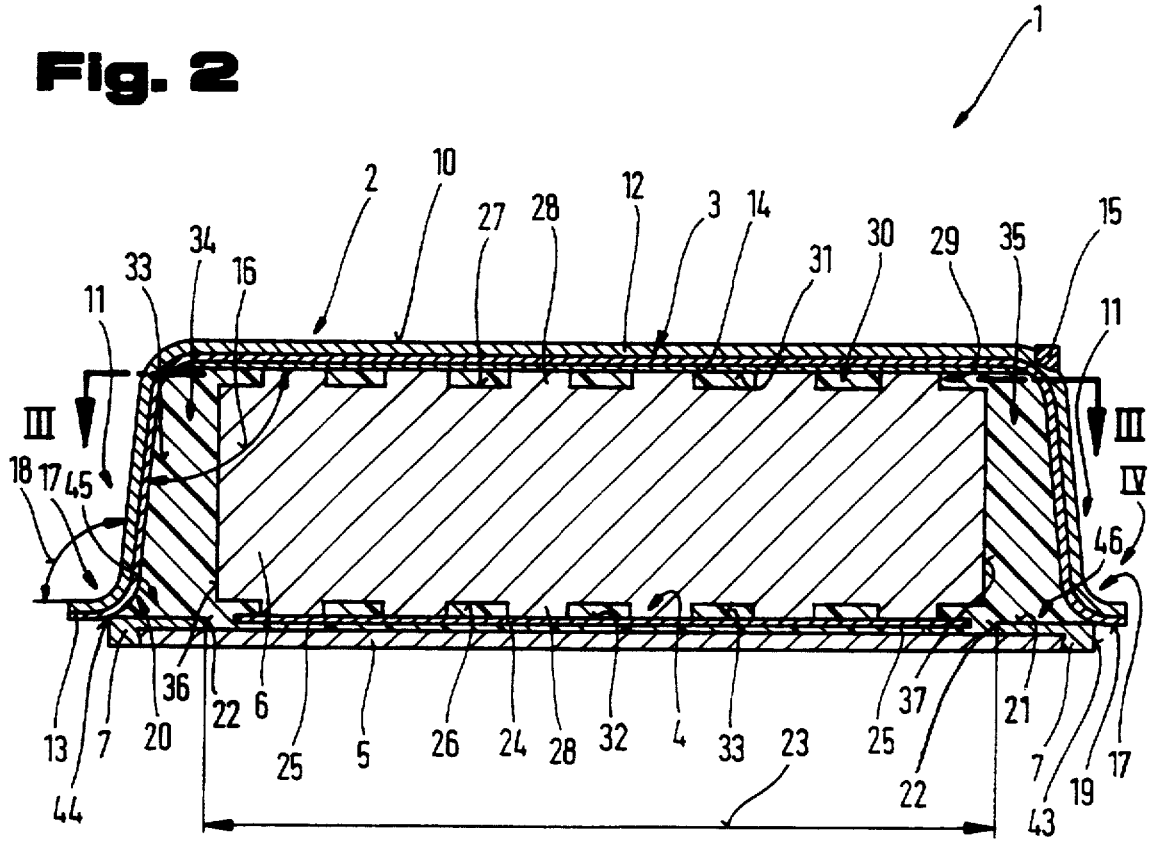
FIG. 2 is a front view of a ski according to FIG. 1 on a larger scale, in a section taken along the lines II—II in FIG. 1.
Figure 3:
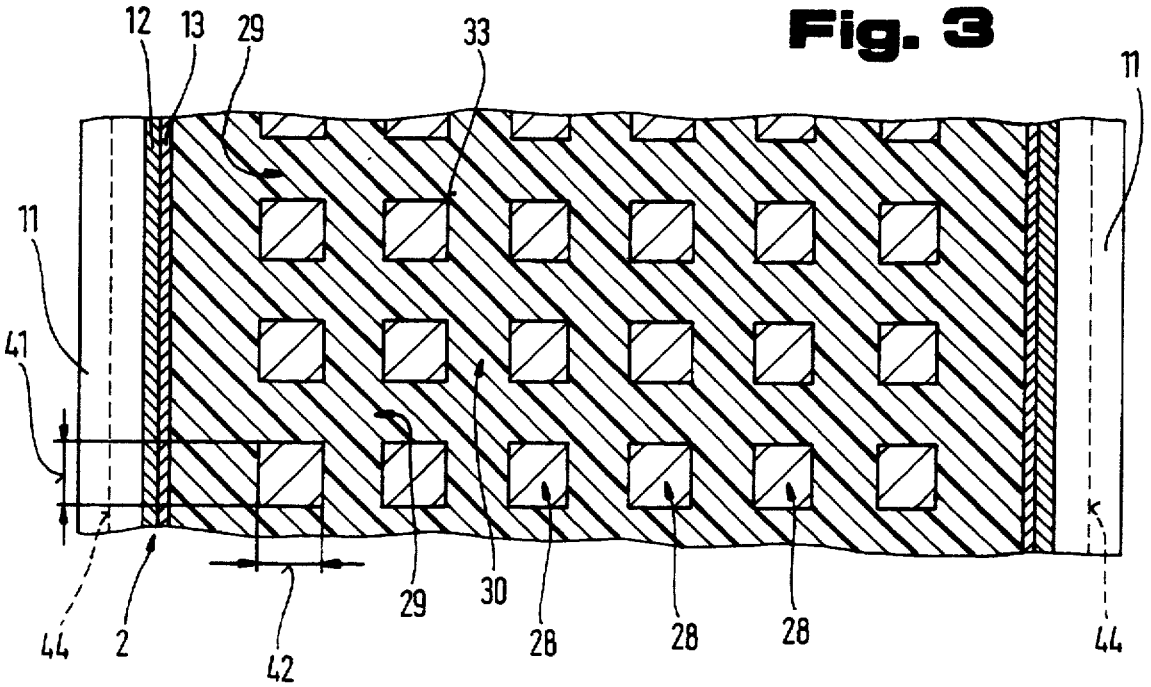
FIG. 3 is a top view of a ski according to FIGS. 1 and 2, in a section taken along the lines III—III in FIG. 2.

As can be seen best from FIGS. 2 to 4, shell 2 having a U-shaped cross section consists of a cover ply 12 and a reinforcement layer 13 is applied to shell 2 at the inside thereof, for example a prepeg or a mat made of reinforcing fibers. The connection between this reinforcement layer 13 and shell 2 can be produced by impregnating reinforcement layer 13 with bonding agents, which react under the influence of pressure and temperature. It is, of course, also possible to produce this connection by applying an additional adhesive layer. Cover ply 12 is connected to another intermediate layer 14, which can be connected to reinforcement 13 by connecting means as described hereabove. This intermediate layer 14 can be composed of metallic or non-metallic materials, in particular aluminum or steel, tear-resistant synthetic materials, or fiber-shaped reinforcing materials.

The shanks of U-shaped shell 2 form a pair of side faces 11. The transition area between surface 10 and side faces 11 can be rounded or, if desired, also angular. It is, of course, also possible when prefabricating shell 2 from cover ply 12 and reinforcement layer 13 to embed protective edges 15 in this transition area at the same time intermediate layer 14 is applied, which is shown purely schematically in the right transition area in FIG. 2.

The parts of shell 2 which form side faces 11 and those parts of the shell which form surface 10, that is to say the base of the U-profile shaped shell, enclose an angle 16 that is preferably greater than 90 degrees.

The free ends of the shanks facing away from the base of shell 2 forming surface 10 are bent, which causes the formation of a projection 17 running approximately parallel to surface 10 of shell 2 and extending in the direction facing away from ski core 6. A bending angle 18 enclosed between projection 17 and side face 11 is equal to, or greater than, inner angle 16.

Upper side 21 of running edges 7, which border running surface layer 5 on its sides, abuts an inner surface 19 of projection 17 in a curved or bent transition area 20 between projection 17 and side faces 11. Bottom strap 4 is arranged between two facing sides 22 of running edges 7 that are preferably distanced at an extent 23. In the illustrated embodiment, bottom strap 4 is formed from a metallic reinforcement layer 24, which is kept at a distance from running surface layer 5 by means of spacers 25. Ski core 6 is arranged between intermediate layer 14 and reinforcement layer 24 of bottom strap 4.

As can be seen best from FIG. 3, a lower side 26 facing towards bottom strap 4 as well as an upper side 27 of ski core 6 facing towards shell 2 are provided with projecting supporting elements 28. As can be seen clearly from FIG. 3, these supporting elements 28, which are distributed over the upper and lower sides 27 and 26, define cross-channels 29 and longitudinal channels 30 therebetween, i.e. a coordinated network of depressions. Therefore, a continuous hollow space is formed between lower side 26 and upper side 27 as well as inner sides 31, 32 of intermediate layer 14 and reinforcement layer 24 facing toward them. This hollow space is filled with a plastic material 33, which provides a connection between these individual layers, in particular intermediate layer 14 and reinforcement layer 24, and ski core 6. This plastic material 33, which can be an elastomer foam or any other plastic foam or a foaming synthetic resin or a similar material, serves also fill an intermediate space 34, 35 which is limited by the shanks forming the pair of side faces 11, top strap 3, bottom strap 4 and side walls 36, 37 of ski core 6 facing towards the shanks.

Plastic material 33 filling intermediate spaces 34, 35 serves at the same time to connect the wall parts of shell 2 and ski core 6 and bottom strap 4, that is running surface layer 5 and running edges 7, that limit these intermediate spaces. The plastic material used to fill and to connect intermediate spaces 34, 35 consists preferably of a 2-component synthetic material on a polyurethane basis, advantageously an elastomer foam.

It is advantageous if the plastic material has a Shore hardness D between 65 and 90, preferably 72 to 78. In the above mentioned embodiment, the plastic foam has a Shore hardness D from 75 to 76, for example.

In order to provide sufficient strength, it is possible to use a plastic material that has a density between 0.5 and 1.5 kg/dm$^3$, preferably presenting a density of 0.9 and 1.1 kg/dm$^3$.

This ensures that elasticity and strengthening properties can be coordinated and, with sufficient strength of the overall construction, adequate damping of blows, vibrations and deformations of the ski can be provided.

By spacing reinforcement layer 24 of bottom strap 4 by means of spacers 25 from running surface layer 5, a connection between the two last-mentioned parts can be achieved by injecting the plastic material.

As can be seen further from the illustration in FIG. 4, in spite of a seal between inner surface 19 in transition area 20, between the pair of side faces 11 and projections 17 of shell 2 and running edge 7, having an appropriately strong rounding with a radius 38 in transition area 20, a hollow space tapering towards zero is created between running edge 7 and inner surface 19, so that plastic material 33 provides a sufficiently strong and permanent connection of these parts which can easily withstand the strong loads in these regions and prevent any delamination.

Due to an appropriate formation of projection 17, said projection can at the same time also serve as spring arm in relation to shell 2 so that any blows on running edge 7 can be damped by virtue of an elastic deformation of projections 17 returning to its initial state.

Of course, this damping effect can be further increased if the elastic deformation values of plastic material 33 in use are high and the distance from bearing edge 39 in the direction of front side 22 of running edge 7 towards shell 2 is increasing rapidly so that there is also an adequate range of spring to dampen the blows onto running edges 7.

Running edge 7 in the region of its front side 22 can also be connected with running surface layer 5 by means of an adhesive layer 40. It is also possible, for example, when running surface layer 5 is produced, to mold it on immediately to running edges 7 during extrusion.

The advantage of the above described embodiment lies in the fact that once prefabricated shell 2 has been put into a form and ski core 6 inserted and bottom strap 4 with running surface layer 5 and running edges 7 is applied, the remaining hollow spaces are filled with plastic material 33, in particular with a plastic foam of an elastomer, and that its viscosity is such that it penetrates even the tightest intermediate spaces between ski core 6 and top and bottom straps 3, 4 to create a tight seal among these components when these hollow spaces and intermediate spaces 34, 35 are filled.

By selecting the elasticity properties of the plastic material or the plastic foam which is used to fill the hollow space or intermediate spaces 34, 35, the damping properties of the ski can be predetermined when it is being deformed by blows.

Thereby, it is also possible to modify the ratio between the surfaces of ski core 6 by which the latter is connected by means of plastic material 33 with top strap 3 or its intermediate layer 14, and the sum of the supporting surfaces, which are composed of a length 41 and width 42 of the surface of supporting elements 28 facing towards top strap 3.

The smaller the surface portion that is composed of the sum of the supporting surfaces consisting of length 41 and width 42 or the diameter of supporting elements 28 in comparison to that surface portion through which the joining between ski core 6 and top strap 3 by the use of plastic material 33 takes place, the stronger is the effect of damping when ski 1 is deformed by the effects of blows on the ski.

The structure of the shanks forming side faces 11 of shell 2, and their sealing abutment against running edges 7, makes it furthermore possible that, once plastic material 33 is in place in the hollow spaces between ski core 6 and top and bottom straps 3, 4 and intermediate spaces 34 and 35, projection 178 can be removed by a cutting and grinding process along the broken line in the right part of FIG. 4, so that side faces 11 are flush with an outer surface 43 of running edge 7 facing away from the ski core.

In this case, a limiting line 44 for receiving chambers 45, 46 tapering from intermediate spaces 34, 35 in the direction of outer surfaces 43 of running edges 78—as seen in FIGS. 2 and 4 —is formed by bearing edge 39 that abuts inner surface 19 of shell 2. Limiting line 44 is schematically indicated by broken lines in FIG. 3 and runs, therefore, in the plane of outer surface 43.

FIGS. 5 and 6 show a further embodiment of a ski 1 in accordance with the invention. Reinforcement layer 24 of bottom strap 4 is also spaced from lower side 26 of ski core 6 by supporting elements 28. On the other hand, it is held by spacers 25 at a distance 47 from running surface layer 5. Depressions 48 between supporting elements 28 are also filled with the same plastic material 33 as intermediate spaces 34 and 35, which has been described in the embodiment of FIGS. 2 to 4.

Distance 47 between reinforcement layer 24 and running surface layer 5 as well as a height 49 of supporting elements 28 can be selected in such a way that the viscosity of the used plastic material 33 is sufficient for penetration into these hollow spaces and able to fill them completely or can also be increased above this minimum so that the desired damping properties are improved in case the ski is deformed or bent through or running surface layer 5 is affected by blows.

This construction of ski 1 allows for the insertion of ski core 6 and the parts of bottom strap 4, that is running surface layer 5 connected advantageously into a single component with running edges 7 by gluing or molding or a similar process. In this connection, it is advantageous that projecting extensions 51 are arranged on a surface 50 of running edges 7 facing towards intermediate spaces 34, 35. Of course, the extensions can also be formed by notches in running edges 7 that are bent upwards by 90 degrees, distance 52 between outer surface 43 of running edge 7 and a side wall of the extension facing towards being equal or greater than a thickness 53 of shell 2 in the region of the pair of side faces 11. This enables appropriate positioning of the shanks of U-profile shaped shell 2 so that projections 17 tightly abut bearing edge 39 of running edge 7. This facilitates the insertion of the individual parts for the production of the ski in accordance with the invention.

As can be seen in particular from the illustration in FIG. 6, supporting elements 28 are formed by pyramids with square bases. Of course, it is also possible that the base has any other desired form, and supporting elements 28 can also be in the form of truncated pyramids instead of pyramids. But the embodiment of supporting elements 28 in the form of pyramids has the advantage that the portion of the face which presents a stiff joint between ski core 6 and top strap 3 or shell 2 is only a fraction of the entire transitional face that is filled with plastic material 33, between ski core 6 and shell 2. This decreases the direct transmission of blows from running surface layer 5 onto ski 1 and improves the damping properties of the ski, in particular at high frequency vibrations and strong bending in the direction of running surface layer 5. This damping, in particular when the ski is bent through in the direction of running surface layer 5, is caused by the stearing movement or the relative movement between top strap 3 and ski core 6 or the latter and bottom strap 4, due to the elastic properties of plastic material 33. These damping properties can be improved by increasing height 49.

By selecting height 49 and the possible formation of truncated pyramids instead of pyramids, this embodiment makes it possible to adapt quickly the direct joining surface between ski core 6 and top and bottom straps 3, 4 to the differently desired characteristics of a ski. As can be seen further from this illustration, angle 54 between running surface layer 5 and a side wall 36 or 37 at core 6 is greater, for example 90 degrees, than the same angle 55 between running surface layer 5 and side faces 11 of shell 2.

To increase the flexibility or the damping of the blows acting upon ski 1 in the region of running edges 7, and to decrease the rigidity of the ski correspondingly, it is possible to enlarge the cross-sectional area of intermediate spaces 34, 35. As schematically illustrated in FIG. 5 by broken lines, the cross-sectional area can be enlarged by decreasing angle 54. This is recommended, particularly in the direction of the rear or leading end of the ski since this allows for a deformation of the ski when it is being bent through in the direction of running surface layer 5 without high stresses. It is also advantageous if the cross-sectional area of the intermediate space in which the outer running edge, i.e. the running edge facing away from the second ski of the skier, is larger because it improves the elastic properties and provides for a so-called "fault forgiving" ski, whereas the inner edge is reinforced accordingly and allows for precise guiding of the ski.

Figure 9:
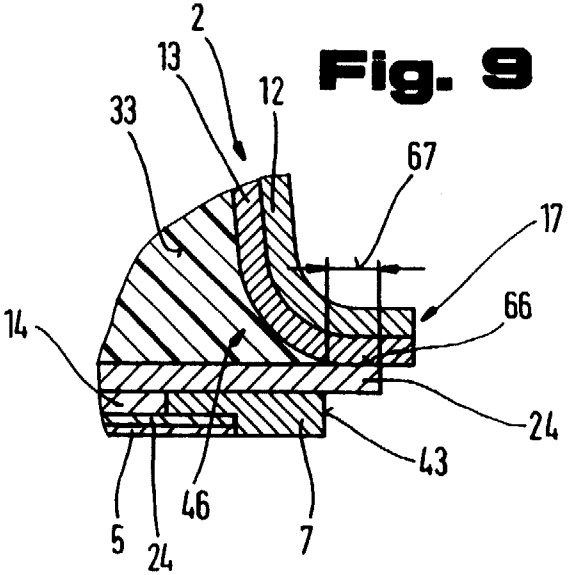
FIG. 9 shows the transition area between the bottom strap and the shell on a larger unproportional scale according to arrow IX in FIG. 7.
Figure 7:
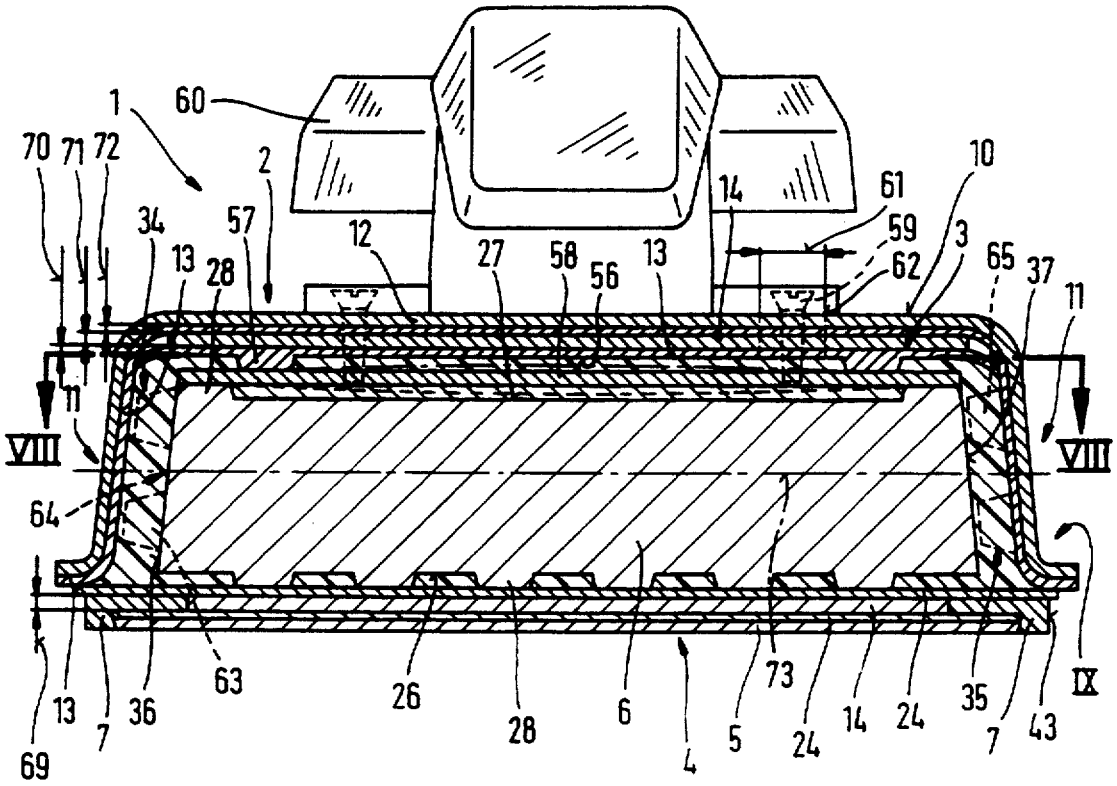
FIG. 7 is a sectional front view of a further embodiment of a ski in accordance with the invention.
Figure 8:
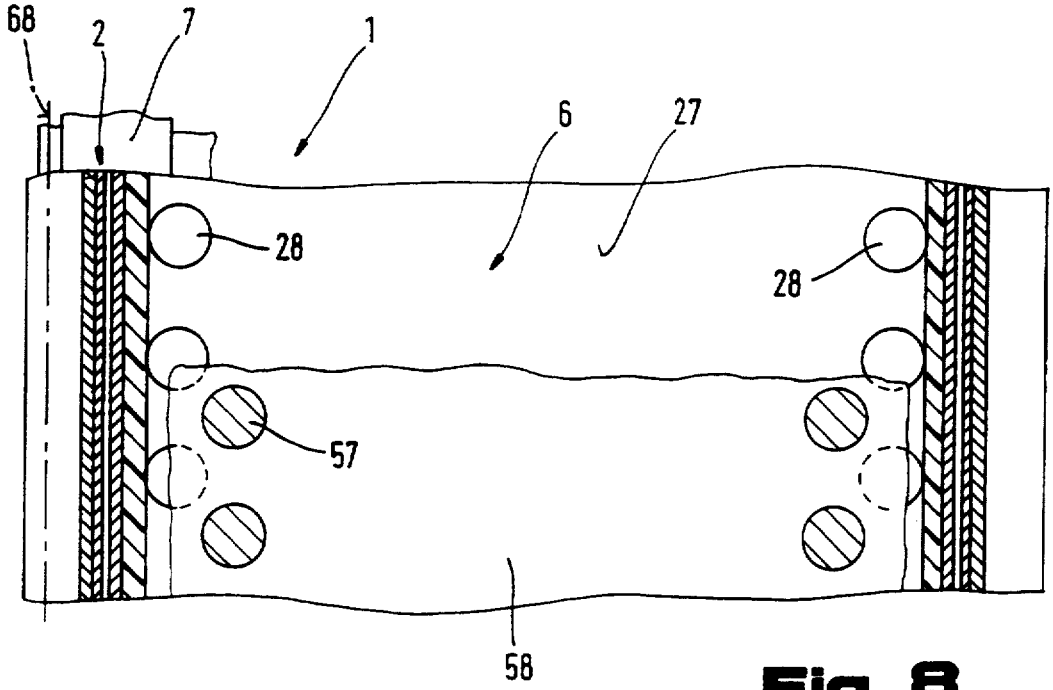
FIG. 8 is a top view of the ski according to FIG. 7, in a section taken along the lines VIII—VIII in FIG. 7.

FIGS. 7 to 9 show another embodiment of a ski 1 in accordance with the invention. In this embodiment of ski 1, both the top strap as well as the bottom strap consist of several layers. In this embodiment, shell 2 is formed of a cover ply 12 and also a reinforcement layer 13 which run through the entire cross sectional region of shell 2. In the region of surface 10 of the ski, another additional reinforcement layer 13 is arranged which is spaced from first-mentioned reinforcement layer 13 by an intermediate layer 14. If, in contrast to reinforcement layers 13, a material with low mechanical properties, for example with a higher elasticity modulus or a higher elasticity or less tensile or bending strength is used for intermediate layer 14, these layers form a sandwich element of its own wherein intermediate layer 14 becomes the core of this sandwich element. The above-described layers are connected with one another in a form-locked manner during the manufacture and formation of shell 2, and an inner side 56 opposite surface 10 of the ski can be associated with a forming surface or a molding plug with depressions—however, this is not absolutely necessary—by means of which supporting elements 57 can be produced that project beyond this inner side in the direction of ski core 6. These supporting elements 57 can, of course, be arranged and distributed uniformly over the whole inner side 56, as in the above described embodiments. In the present embodiment, however, they are only arranged in one or, for example, two very close rows of the outer regions of ski core 6 facing towards side walls 36, 37.

Accordingly, supporting elements 28, which project beyond surface 27 of ski core 6 facing towards top strap 3, are arranged, for example, only in one or perhaps also two rows running parallel to one another in the marginal portions that are associated with side walls 36, 37.

An anchoring plate 58 is arranged between supporting elements 57 and 28. This anchoring plate 58 serves, as indicated schematically, to receive fastening elements 59 by means of which a toe clamp 60 of a ski binding can be fastened to surface 10 of ski 1.

As can be seen easily by the positions drawn in broken lines, a free-floating positioning of anchoring plate 58, in particular its bending in various directions, can be obtained by filling the depressions between supporting elements 57 and 28 with the plastic material which also fills intermediate spaces 34, 35. If a plastic material or a plastic foam with sufficient elastic properties is in use, then anchoring plate 58 can be deformed when impact stresses or stresses by jerks and jolts occur in the direction of the positions indicated by broken or dot-dash lines since it is only fixed in the region of side walls 36, 37 between supporting elements 28 and 57, and can otherwise be deformed by tensile and compressive stresses, if, for example, fastening elements 59 holding toe clamps 60 have a cylindrical section without any threads throughout the thickness of shell 2.

It is, of course, also possible—as indicated in broken lines—to select a diameter 61 of a bore 62 that is greater than the outer diameter of fastening elements 59, e.g. a fastening screw, so that the deformation possibilities of anchoring plate 58 can damp vibrations or impacts in other spatial directions and not only perpendicular to surface 10.

It is, of course, also possible within the scope of the invention to eliminate supporting elements 28 and 57 in the region of side walls 36, 37 and to keep anchoring plate 58 positioned by other means in the hollow space formed between top strap 3 and ski core 6 until plastic material 33 is injected, whereupon anchoring plate 58 is kept in this hollow space only by virtue of the elastic properties of the plastic material.

Furthermore, bottom strap 4 has, besides running surface layer 5, two reinforcement layers 24 with an intermediate layer 14 arranged between them, which consists of a mechanically less rigid material, as already indicated above with regard to intermediate layer 14. Reinforcement layer 24 that is closer to ski core 6 can thus advantageously extend sidewards or project beyond the limit that is established by outer surfaces 43 of running edges 7.

A spacing between ski core 6 and this further reinforcement layer 24 can also be achieved by supporting elements 28 formed on ski core 6 or on additional reinforcement layer 24. Reinforcing elements 28 and 57 have the form of truncated cones. However, any other form, in particular according to the other embodiments, can also be used.

It is also possible to arrange projections 63 in the region of side walls 36, 37 which protrude from ski core 6 in the direction of the shanks of shell 2 forming the pair of side faces 11. Between these projections are depressions 64 which form a coherent network or a cavern system, which is also filled in by plastic material 33 that fills intermediate spaces 34, 35 and which creates in addition to the connection of shell 2 with ski core 6 also a connection with ski core 6 and bottom strap 4.

It is, of course, also possible that no supporting elements 28 are arranged on lower side 26 of ski core 6 but that it is by means of an adhesive layer connected with adjacent reinforcement layer 24, and that ski core 6 with bottom strap 4 comprising running surface layer 5 as well as running edges 7 forms a semi-finished product, i.e. a prefabricated component. It is also possible that the components forming top strap 3 are directly fixed to ski core 6 so that, with the exception of shell 2, that is to say the outside covering of the surface and the pair of side faces, all parts of the ski are prefabricated. Therefore, it is possible to store different cores for different types of skis so that only by selecting the appropriate plastic material and the appropriate shell with different embodiments according to the design, a whole range of various types of skis can be produced in a simple manner and by the same production process. This decreases also the reject rate during the production of the skis. This kind of production is particularly advantageous when constructing skis with the usual manifold design formations for the same type of ski since the ski core with its appropriate top and bottom straps can be prefabricated in large numbers in a cost-effective manner and depending on the orders received, and can be connected with the shells that have been provided with the design desired by any particular customer.

When producing a ski in accordance with the invention, only two components, namely prefabricated shell 2 and a prefabricated core component, are assembled and connected by means of plastic material 33 which achieves the desired elasticity and damping properties. By virtue of the various embodiments and alternate combination of different types of shells 2 and core components, the finishing of skies for different purposes is achieved with the same technology in a simple way.

The arrangement of projections 63 in the region of side walls 36, 37 or raised portions 65, that extend from the reinforcement layer in the direction of ski core 6, ensures precise positioning and forming of ski 1, in particular the position of the pair of side faces 11.

As can be seen best from FIG. 9, the projecting portion of additional reinforcing layer 24 beyond outer surface 43 of running edge 7 causes the formation of a contact surface 66 with a width 67 between additional reinforcement layer 24 and projection 17 of shell 2. This contact surface 66 is separated in the direction of ski core 6, as indicated in FIG. 8, by limiting line 68 from receiving chamber 46 between shell 2 and additional reinforcement layer 24. By covering shell 2 and additional reinforcement layer 24 over width 67, proper fixing and compression of these parts in a direction perpendicular to running surface layer 5 can be achieved and thus also a tight seal of the hollow space receiving plastic material 33. Through suitable formation of shell 2, limiting line 68 can easily be positioned outside or inside of a plane defined by outer surface 43 of running edge 7.

The ski shown in FIGS. 7 and 8 starting from surface 10 in the direction of running surface layer 5 is composed of the following layers:

Shell 2 mayh be a deep drawn shell formed of polyester, polyethylene or polyamide material or ABS. It comprises cover ply 12 and a fiberglass layer as reinforcement layer 13, ply 12 and layer 13 being connected to each other by an additional adhesive layer or by impregnation of the fiberglass layer with a plastic material or a resin becoming an adhesive under the influence of temperature and/or pressure. Reinforcement layer 13 is followed by intermediate layer 14 of a titanium-aluminum alloy and this is succeeded by another fiberglass layer, which is also preferably impregnated with a plastic material that develops an adhesive effect under the influence of temperature and pressure.

Ski cover 6 can consist of a plastic foam or a lightweight plastic material or also an expanded thermoset plastic or thermoplastics or wood. When using a wood core, this core can be composed of a plurality of individual rods or layers, preferably of different materials. On the bottom of ski core 6 in the direction of running surface layer 5 is a fiberglass layer which can be connected thereto by means of an adhesive or a resin before ski core 6 is put into shell 2. By applying an intermediate layer 14 consisting of a titanium-aluminum alloy or aluminum and preferably having a thickness that corresponds to a thickness 69 of a holding flange of running edges 7, running edges 7 can be held by a further reinforcement layer 24, namely a fiberglass layer, located between intermediate layer 14 and running surface layer 5. The individual parts of bottom strap 4 are joined among themselves by adhesives or resins which during prefabrication of the component consisting of ski core 6 and bottom strap 4 are connected to one another. Then, the component is connected to shell 2 by plastic material 33 injected into intermediate spaces 34, 35 and the recesses or depressions between the component and shell 2.

Reinforcement layers 13 and 14 in the immediate vicinity of ski core 6 have preferably a same wall thickness 70–72 as intermediate layers 14 and reinforcement layers 13 and 24 that are closer to surface 10 and running surface layer 5. Depending on the anticipated stresses or the areas of use of the ski, wall thickness 70–72 of intermediate layer 14 and reinforcement layers 13, 24 being closer to ski core 6, or of reinforcement layers 13, 24 being more distanced from the latter, can also vary. It should be noted that greater rigidity of reinforcement layers 13, 24 which are farther spaced from horizontal median plane 73 enhance the rigidity of the ski more than if the thickness or strengthening properties of reinforcement layers 13 or 14 being closer to ski core 6 are increased.

Since the titanium-aluminum alloy of intermediate layer 14 has less strength, in particular tensile strength, and has a higher elasticity modulus than reinforcement layers 13 and 24, reinforcement layers 13 with intermediate layer 14 and reinforcement layers 24 with intermediate layer 14 arranged between them, form relative to the adjacent components a tension-neutral component which can show a totally different expansion behavior, especially under the effect of temperature changes, with respect to other layers of the ski. This symmetrical structure and arrangement of reinforcement layers 13, 24 and intermediate layer 14 can, of course, also be used when reinforcement layer 13 of top strap 3 rests tightly against ski core 6 and the anchoring is effected by fastening elements 59 in cover ply 12 or outer reinforcement layer 13 or an anchoring plate 58 arranged between them.

Figure 10:
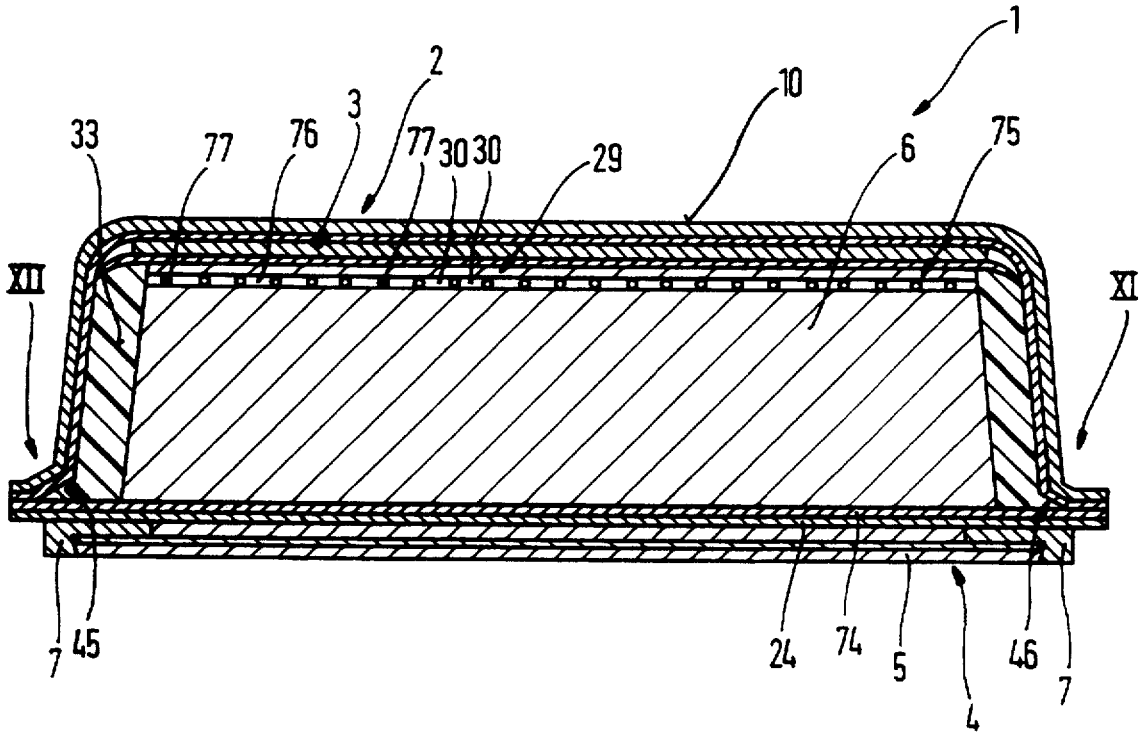
FIG. 10 is a sectional front view of a ski in accordance with the invention, with different formations of the transition area between the shell and the bottom strap in the region of the running edges opposite each other.
Figure 12:
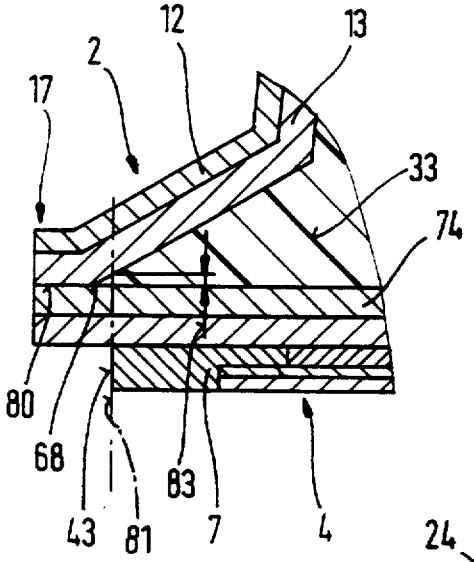
FIG. 12 shows the transition area between the bottom strap and the shell on a larger unproportional scale according to arrow XII in FIG. 10.
Figure 11:
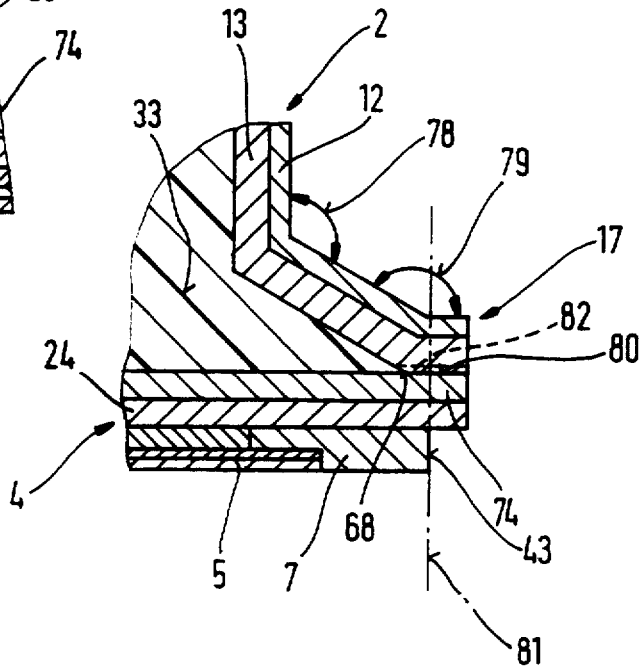
FIG. 11 shows the transition area between the bottom strap and the shell on a larger unproportional scale according to arrow XI in FIG. 10.
Figure 13:
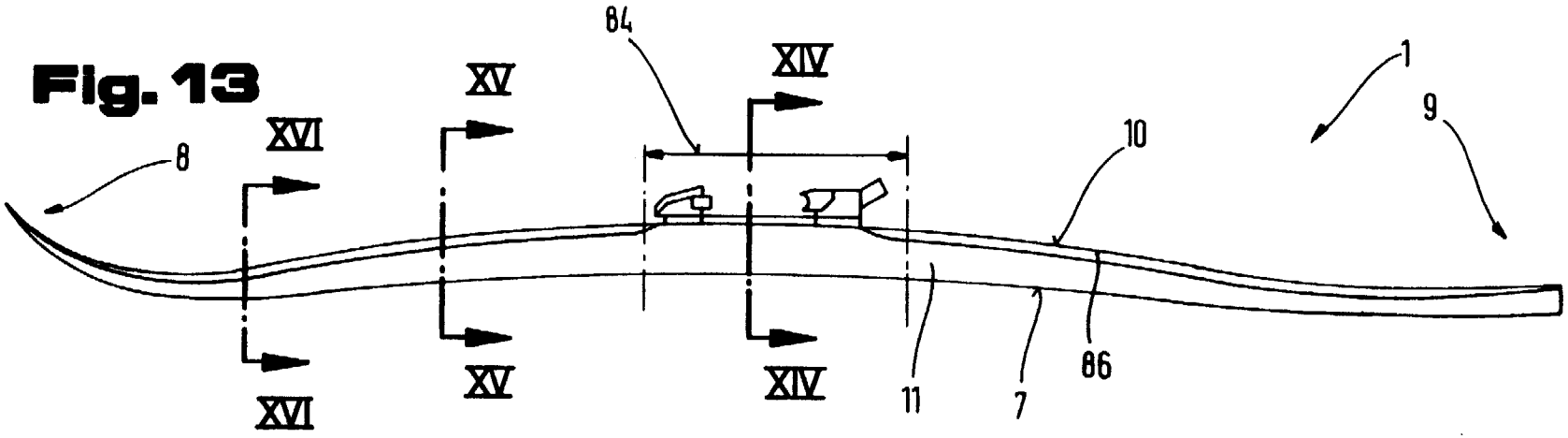
FIG. 13 is a side view of a ski in accordance with the invention with a binding illustrated in a simplified, schematic form.

FIGS. 10 to 12 show a further embodiment of ski 1 in accordance with the invention.

FIG. 10 shows different embodiments of receiving chambers 45, 46 in the region of running edges 7 opposite from one another. These receiving chambers are shown at a larger scale in FIGS. 11 and 12.

The structure of ski 1 corresponds essentially with the embodiment described in FIGS. 7 to 9. This is why for identical parts, identical reference numbers have been used. One difference is the arrangement, between ski core 6 and reinforcement layer 24 that is closer to it, of an additional intermediate layer 74 consisting of a layer of carbon fibers or ceramic fibers, for example, in bottom strap 4.

The individual layers of bottom strap 4 as well as running surface layer 5 and running edges 7 form together with ski core 6 a prefabricated component, which is connected via plastic material 33 with shell 2, in which in the region of surface 10 of the ski top strap 3 is integrated. To create appropriate connecting surfaces between ski core 6 and top strap 3, a spacing insert 75 is arranged between these two components. This insert is in the form of a grid which consists of transverse rods 76 and longitudinal rods 77. Transverse and longitudinal running rods 76, 77 have both a thickness or a diameter that is equal to the desired thickness of the connecting layer between ski core 6 and shell 2. Transverse rods 76 running diagonally to the length of the ski form transverse channels 29 and longitudinal rods 77 running in the longitudinal direction of the ski form length channels 30, through which plastic material 33 can pass and thus create the connection between ski core 6 and shell 2.

FIGS. 11 and 12 show different embodiments of the joining or the connection of shell 2 with bottom strap 4 of the component enclosing ski core 6. The cover and reinforcement plies 12, 13 in their end region facing towards bottom strap 4 are bent twice outwardly by angles 78 and 79, that are larger than 90 degrees, and selected in such a way that the end of projection 17 facing away from ski core 6 runs parallel to running surface layer 5 and to immediately adjacent immediate layer 74. In the embodiment of FIG. 11, limiting line 68 of a contact surface 80 between projection 17 and intermediate layer 74, shown schematically by a point, is located inside a plane 81 defined by outer surface 43 of running edge 7, indicated schematically by a dash-dot-line. Limiting line 68 is, therefore, closer to ski core 6 than outer surface 43 of running edge 7.

Whereas from ski core 6 all the way into the region of limiting line 68 there is a perfect connection of intermediate layer 74 with shell 2 thanks to plastic material 33, in order to achieve a connection in the outer region of projection 17, it is necessary either, as shown in broken lines, to arrange an adhesive layer 82 or to provide reinforcement ply 13 of shell 2 in the region of projection 17 immediately after limiting line 68 with cross-flow grooves running transverse to the longitudinal direction of the ski so that plastic material may also advance into these regions and create a connection between the individual parts. This ensures, once projection 17 has been removed by milling or grinding or cutting until it in true alignment with outer surface 43 of running edge 7, a tight connection between shell 2 and bottom strap 4 which prevents delamination despite high stresses upon ski 1 in this region.

According to the embodiment in FIG. 12 it is, however, also possible that limiting line 68 of contact surface 80 is arranged on the side of plane 81 opposite ski core 6 which receives outer surface 43 of running edge 7. This means that, after projection 17 of shell 2 has been severed to level 83, the connection of shell 2 with bottom strap 4 can only take place by plastic material 33 and, depending on the elasticity or deformation properties of the latter, more or less effective damping of blows to running edge 7 can be achieved.

FIGS. 13 to 17 show schematically another embodiment of ski 1, wherein in the varying transverse planes shown sectionally in FIGS. 14 to 17, intermediate spaces 34, 35 show a different cross-sectional surface. Furthermore, it is also possible increasingly incline side walls 36, 37 of ski core 6 according to the increasing distance from central area 84 of ski 1, where the ski binding is usually mounted on the ski—as schematically indicated—in the direction of the leading end of ski 8 or the rear end of ski 9, in relation to a vertical plane towards a perpendicular longitudinal median plane of ski 85, so that they show a steadily decreasing inclination angle 54. By selecting to change inclination angle 54 over the length of ski 1, its deformation and rigidity properties can also be changed in a simple manner. As indicated in the illustrated cross sections, it is also possible, through step portions 86, that is to say the arrangement of recesses in the longitudinal direction of the ski, to modify the stiffness of the ski in the region of running edges 7 in order to achieve the desired flexibility properties in an easier manner.

Figure 14:
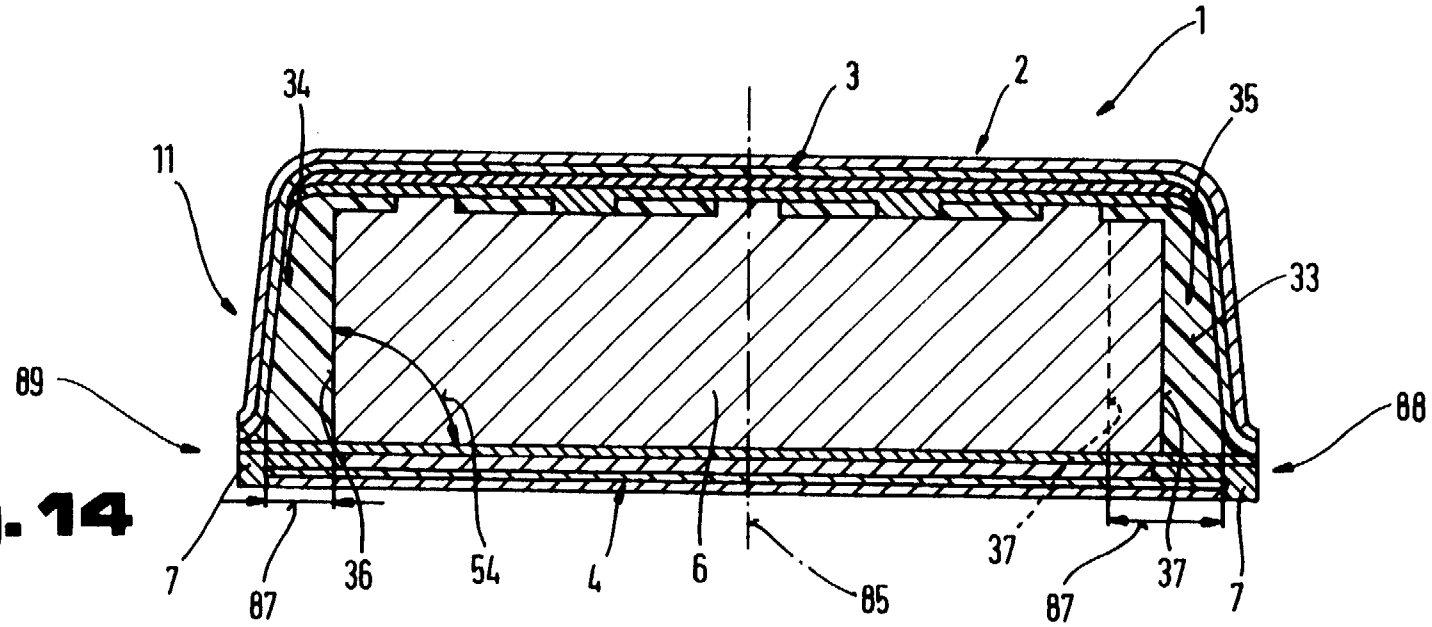
FIG. 14 is a front view of the ski according to FIG. 13 in the region of the ski binding, in a section taken along the lines XIV—XIV in FIG. 13.

In addition, due to varying distance 87 between side face 11 and side walls 36, 37 of core 6, the flexibility properties and the rigidity of ski 1 can be easily modified. Especially when distance 87 between side face 11 and side walls 36, 37, as drawn in broken lines in FIG. 14, is greater in the region of outer edge 88 than in the region of inner edge 89, a higher flexibility of ski 1 is achieved in the region of outer edge 88 and, therefore, a ski which "forgives" running mistakes, while the ski is stiffer in the region of inner edge 89 and, therefore, permits better tracking. Inner edge 89, that is to say the edge which faces the other ski of the ski pair, normally guides the ski. Apart from the small width of ski core 6, this causes intermediate space 35 to become larger than intermediate space 34 and achieves together with the elastic properties of the plastic foam a stronger damping and a less strong moment of torsion.

Figure 15:
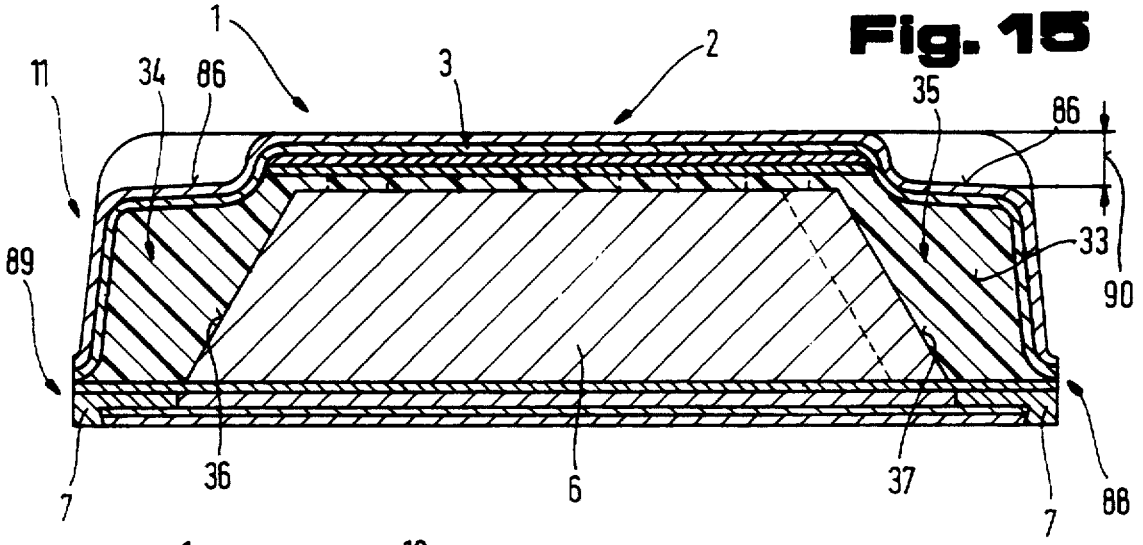
FIG. 15 is a front view of the ski according to FIG. 13, in a section taken along the lines XV—XV.
Figure 16:
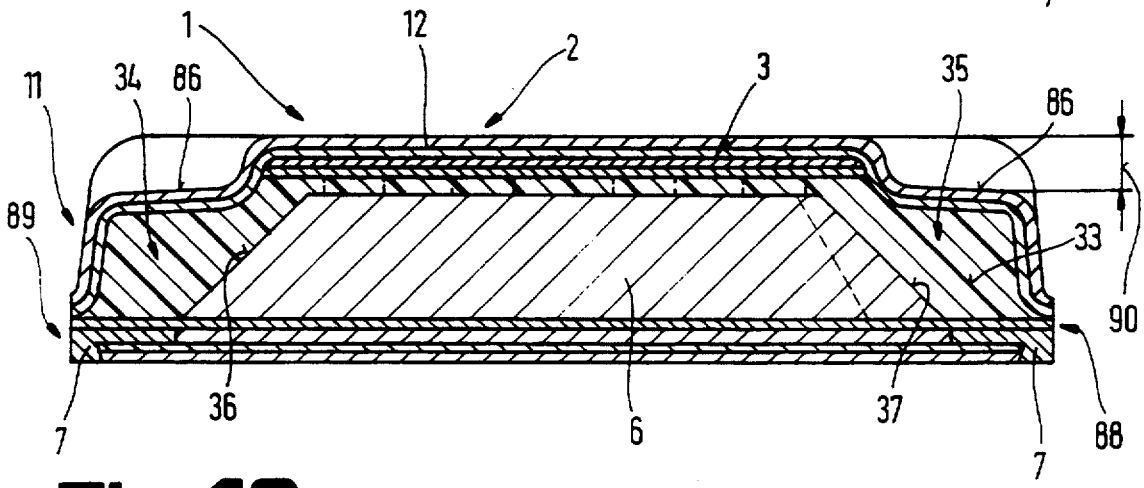
FIG. 16 is a front view of the ski according to FIG. 13, in a section taken along the lines XVI—XVI.

As shown in FIGS. 15 and 16, the higher elasticity in the region of outer edge 88 can extend through the whole length of the ski. Furthermore, due to step portions 86, it is possible to modify the flexibility properties of ski 1 in the edge area so that, for example, a varying height 90 of these step portions 86 along the length of the ski improves the bending of the ski in the shovel and rear end region of the ski. It is, of course, also possible to arrange the step portions only in the region of outer edge 88 or inner edge 89 and not, as shown in the embodiment by way of example, in the region of both edges.

Figure 17:
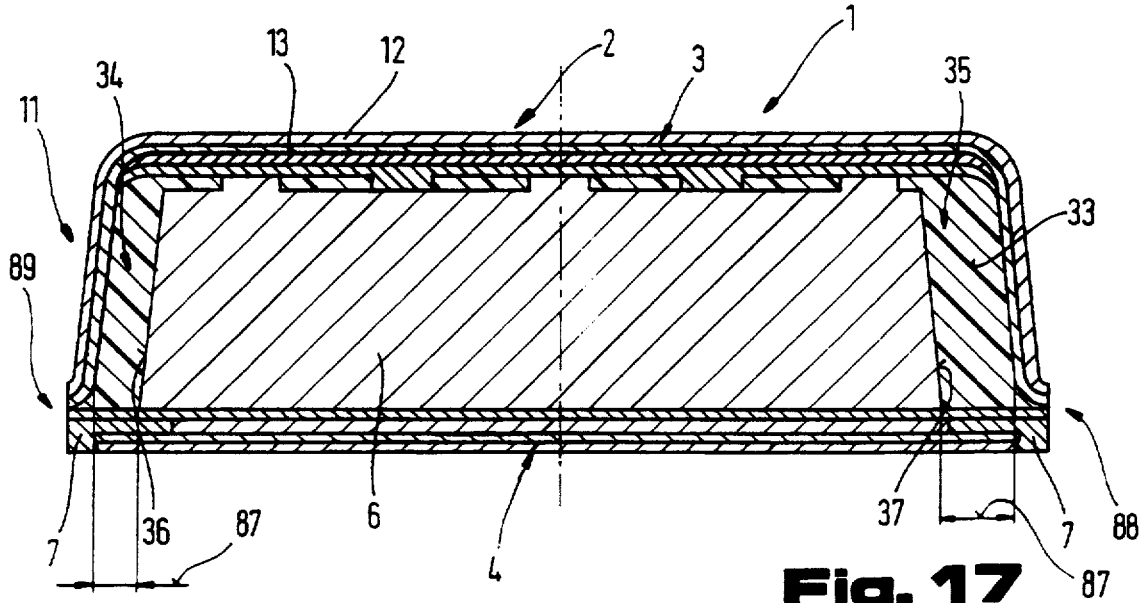
FIG. 17 is a front view of a ski according to FIG. 13, taken along the lines XIV—XIV, however with a modified formation of the ski core.

In contrast to FIG. 14, FIG. 17 shows that side walls 35, 36 of ski core 6 run parallel to side face 11 of shell 2 and at different distances 87 from it.

Moreover, FIGS. 16 and 17 show that ski core 6 can form a semi-finished part not only with bottom strap 4 but also with top strap 3, and that ski core 6 can thus be inserted into shell 2 with top strap 3 and bottom strap 4 as a unitary component. Shell 2 can be reinforced with reinforcement layer 13, as shown in FIG. 17, either only partially in the middle region of the ski or over the whole length, and this reinforcement layer must be only so strong and of such a carrying capacity that it keeps cover ply 12, after this ply has been deformed, in the desired shape, and that the shell, while it is being stored and after its formation, is not distorted.

The reinforcement layer may, of course, also extend beyond the region of side faces 11 which form the shanks.

As already mentioned above with regard to the other embodiments, it is possible to use as a plastic material a two-component polyurethane plastic material or any other materials of an appropriate low viscosity enabling it to penetrate into the hollow spaces or intermediate spaces.

Preferably, such an elastomer foam has a Shore D hardness from 65 to 90, preferably from 72 to 78. At the same time or exclusively, it is also possible that plastic material 33 has a density between 0.5 and 1.5 kg/dm$^3$, preferably 0.9 to 1.1 kg/dm$^3$. This density achieves an appropriate strength when the individual layers are used so that delamination is prevented. The above mentioned hardness guarantees simultaneously an appropriate elastic connection and accordingly good damping of the deformations of the ski or vibrations acting upon the ski.

Reinforcement layers 13, 24 may comprise fabrics, woven cloth, fibrous webs, lattices or meshes of threads from different materials, such as ceramic, for example, metal, glass, carbon or plastic materials, which can either be frictionally connected to the neighboring layer by applying synthetic resins in a so-called cold-mold process or by preimpregnating with appropriate plastic material, plastics adhesives, hot melt adhesives or a foaming plastic material or synthetic resin in a hot-press process. At the same time, the above described materials can also serve as spacing insert 75 if a diameter or a thickness of the threads or rods of the grid or meshes is enough to allow passage of the liquid plastic material at any viscosity of plastic material 33 used to connect the individual layers. After reaction and solidification of the plastic material, a connection between the individual layers of ski 1 is created.

On the other hand, intermediate layers 14, 74 can consist of materials with low tensile strengths, a higher modulus of elasticity or less bending resistance and in particular may have a totally different temperature expansion behavior than reinforcement layers 13, 24.

Figure 18:
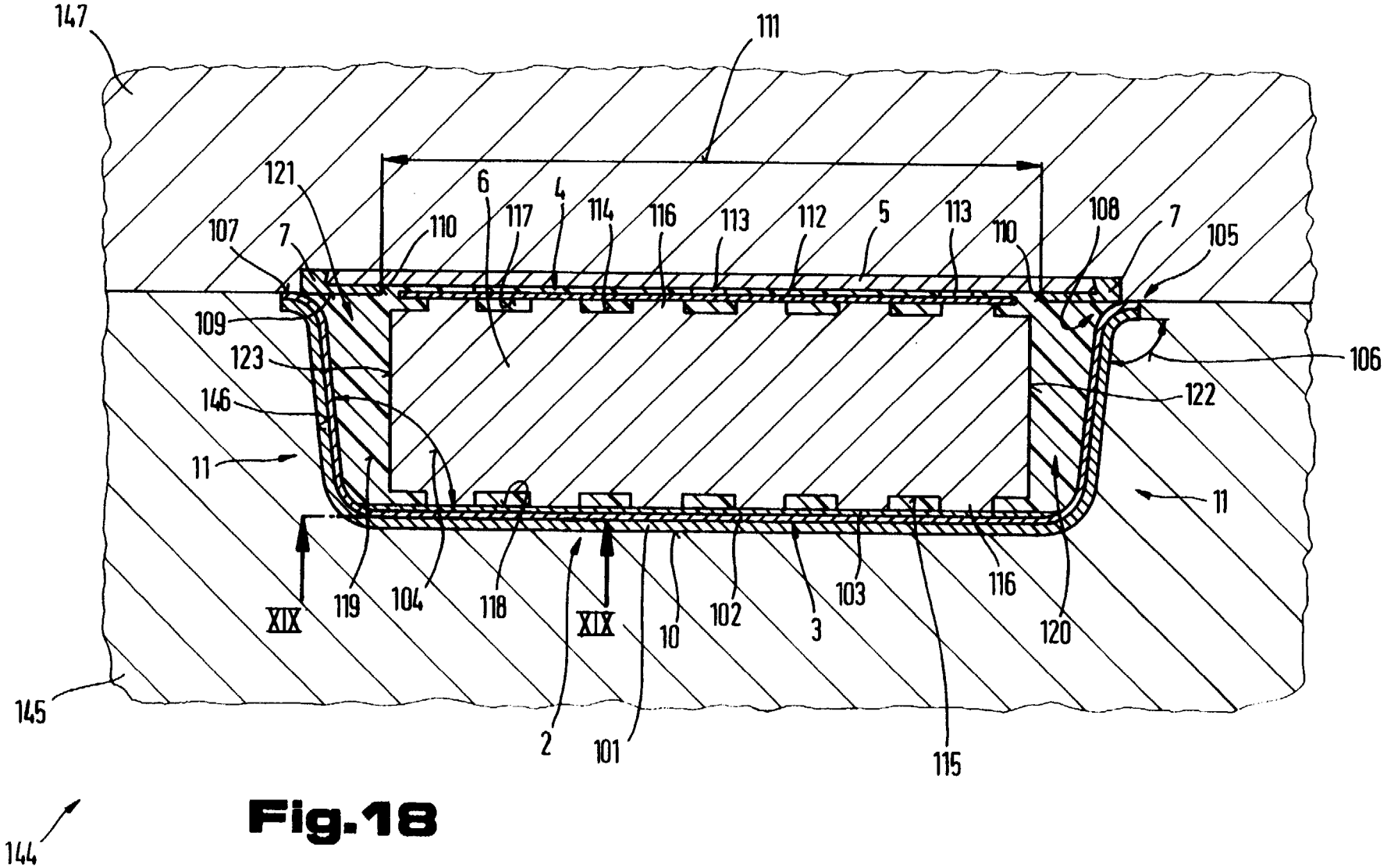
FIG. 18 is an enlarged sectional front view of the ski according to FIG. 1 and its schematically indicated production form.

As can be seen now in FIG. 18, shell 2 having a more or less U-shaped cross section consists of a cover ply 101 to which, in the direction of ski core 6, a reinforcement layer 102 is applied, for example a prepeg or a mat of reinforcing fibers.

The connection between this reinforcement layer 102 and cover ply 101 can take place by bonding agents applied to reinforcement layer 102 which react under the influence of pressure and temperature. It is, of course, also possible to produce the connection between the reinforcement layer and cover ply 101 by arranging for an additional adhesive layer. In the region of the base of U-shape profiled shell 2, cover ply 101 is connected with a further intermediate layer 103 which, in turn, can be connected by the above described connection means to reinforcement layer 102. This intermediate layer 103 may consist of metallic or non-metallic materials, for example, in particular aluminum or steel sheets, or tear-proof plastic material, in particular of fiber-shaped reinforcing materials.

Those parts of shell 2 that form side faces 11 enclose with the parts of the shell forming surface 10, that is to say the base of U-shaped profile shell, an inner angle 104 which is preferably greater than 90 degrees.

The free ends of the shanks facing away from the base of shell 2 that forms surface 10 of the ski are bent, thereby creating a projection 105 which runs about parallel to surface 10 of shell 2 and extends in the direction facing away from ski core 6. A bending angle 106 between projection 105 and side face 11 equals an inner angle 104 or is greater than this inner angle 104.

On top of an inner surface 107 in the region of projection 105, that is in a curved or bent transition area 108 between projection 105 and side face 11, lies an upper side 109 of running edges 7 which border running surface layer 5 on the side. Bottom strap 4 is arranged between two facing sides 110 of running edges 7, which are preferably spaced at a distance 111 in the present embodiment, bottom strap 4 consists of a metallic reinforcement layer 112 which is kept at a distance from running surface layer 5 by means of spacers 113. Ski core 6 is arranged between intermediate layer 103 and reinforcement layer 112 of bottom strap 4.

A lower side 114 facing towards bottom strap 4 as well as an upper side 115 of ski core 6 facing towards shell 2 is provided with protruding supporting elements 116. These supporting elements 116 are distributed over upper or lower sides 115 and 114 and define between themselves cross channels and longitudinal channels, that is to say a continuous network of depressions. Thus, a hollow space is formed between lower side 114 and upper side 115 as well as inner sides 117, 118 of intermediate layer 103 and reinforcement layer 112 facing towards them. This hollow space is filled with a plastic material 119, which at the same time produces a connection between these individual layers, in particular intermediate layer 103 and reinforcement layer 112, and ski core 6. Plastic material 119, which may preferably consist of an elastomer foam or any other plastics foam, or a similar material, fills also intermediate spaces 120, 121 which are limited by the shanks forming side faces 11, top strap 3, bottom strap 4 and side walls 122, 123 of ski core 6 facing towards the shanks.

Plastic material 119 which fills intermediate spaces 120, 121 serves simultaneously as a connection between the wall portions of shell 2 or of ski core 6 limiting these intermediate spaces and bottom strap 4 or running surface layer 5 and running edges 7. The plastic material which fills and connects intermediate spaces 120, 121 is preferably a two-component polyurethane plastic material.

It is advantageous that by virtue of the spacing arrangement of reinforcement layer 112 of bottom strap 4 by spacers 113 at a distance from running surface layer 5 a connection can also take place between the two latter parts by means of plastic material 119.

Figure 19:
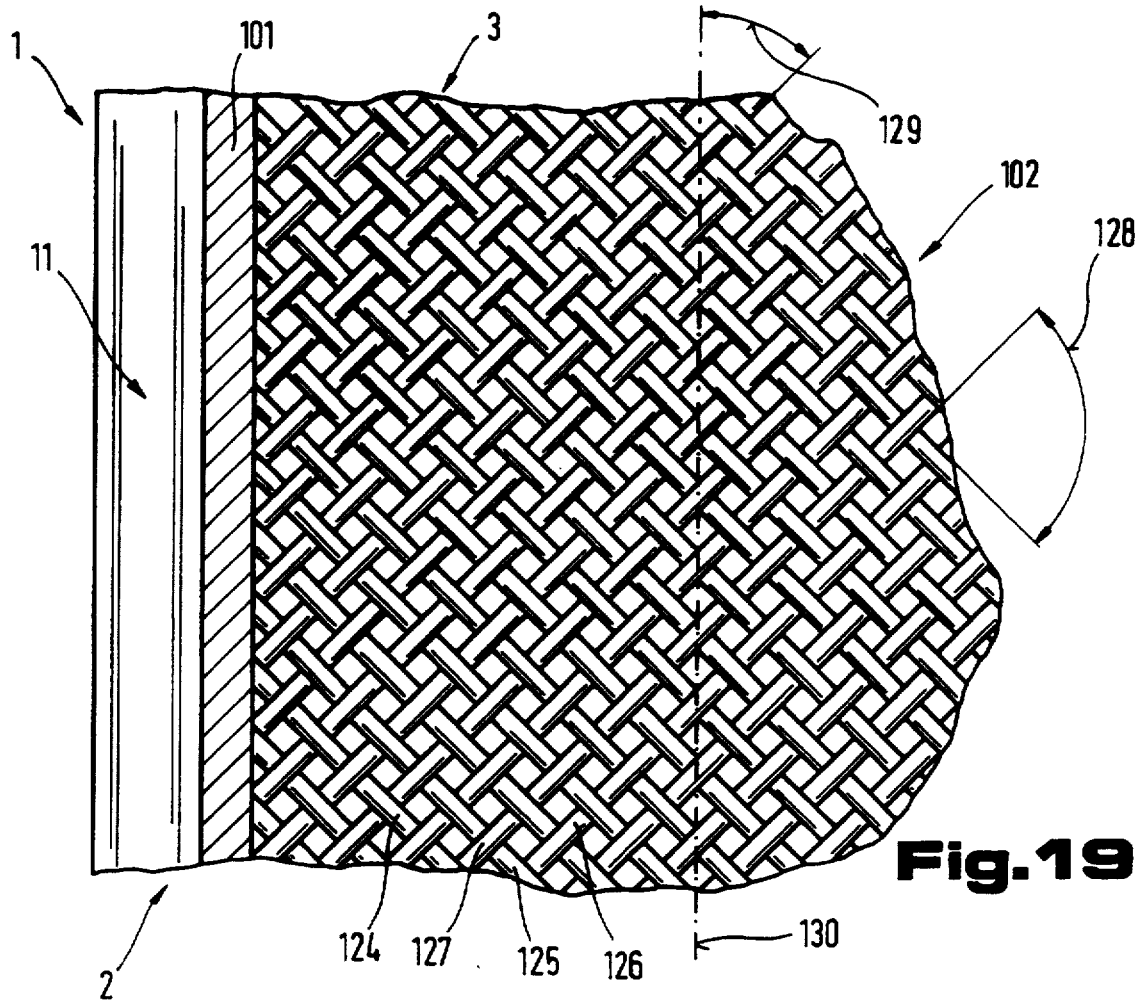
FIG. 19 is a top view of and section along the lines XIX—XIX in FIG. 18 through a part of the ski.

FIG. 19 shows reinforcement layer 102. Said layer consists of threads 124, 125 and 126, 127, threads 124, 125 enclosing an angle 128 with threads 126, 127, in the present case an angle of 90 degrees. This angle 128 may, however, have any optional size between 0° and 90°.

In the present embodiment, threads 124 to 127 form a braiding. They may, however, also form a lattice, a fabric or a nonwoven fabric.

Preferably, these individual threads 124 to 127 are produced from the same material, for example metal or glass or ceramic or carbon. It is, however, also possible that the threads are each formed from a different material and that the tissue or fabric consists of fibers from different materials, arranged in alternating sequence.

Threads 124 to 127 also run at an angle 129 to a longitudinal axis 130 of ski 1. This angle 129 can also be of a different size, for example between 10° and 80°.

Due to the deformation in space of reinforcement layer 102, in particular in the region of side faces 11, a three-dimensional stiffening is achieved in the region of the side faces which leads to an additional stabilization of the form of the shell.

Figure 20:
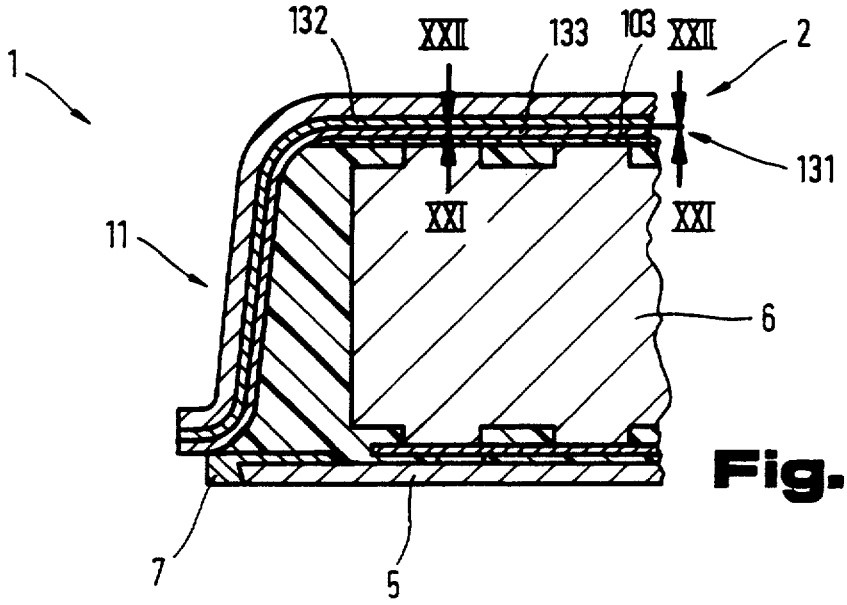
FIG. 20 is a sectional front view of a multi-layered embodiment of the reinforcement layer in the region of the shell.
Figure 21:
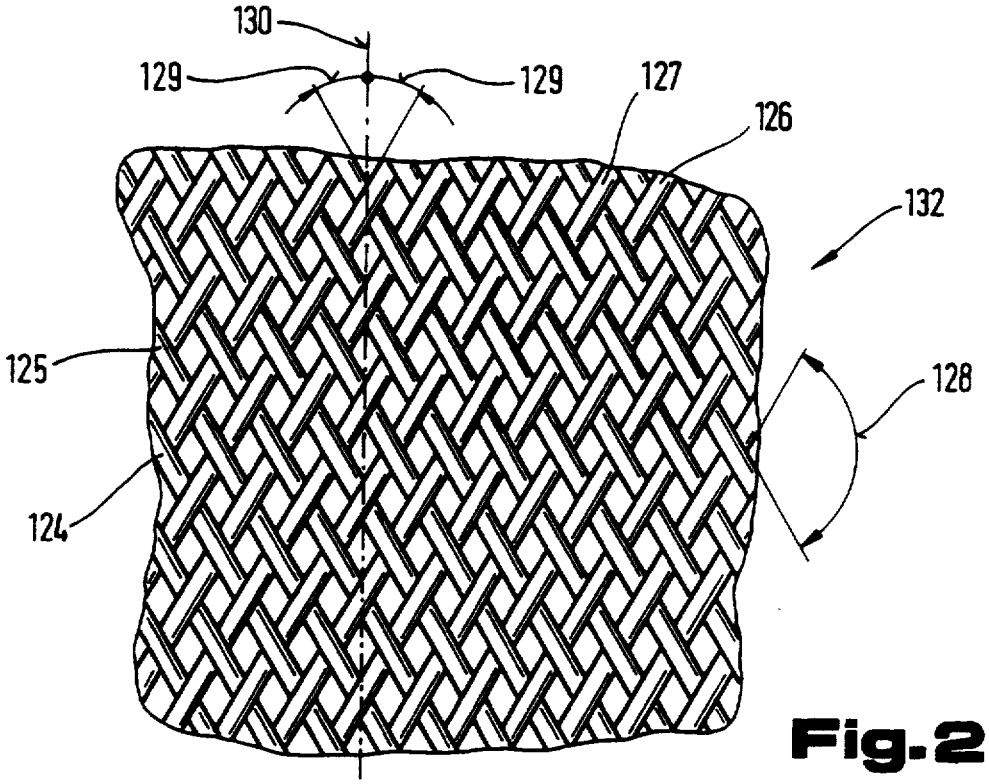
FIG. 21 is a top view and section along the lines XXI—XXI in FIG. 20 through a ply of the reinforcement layer.
Figure 22:
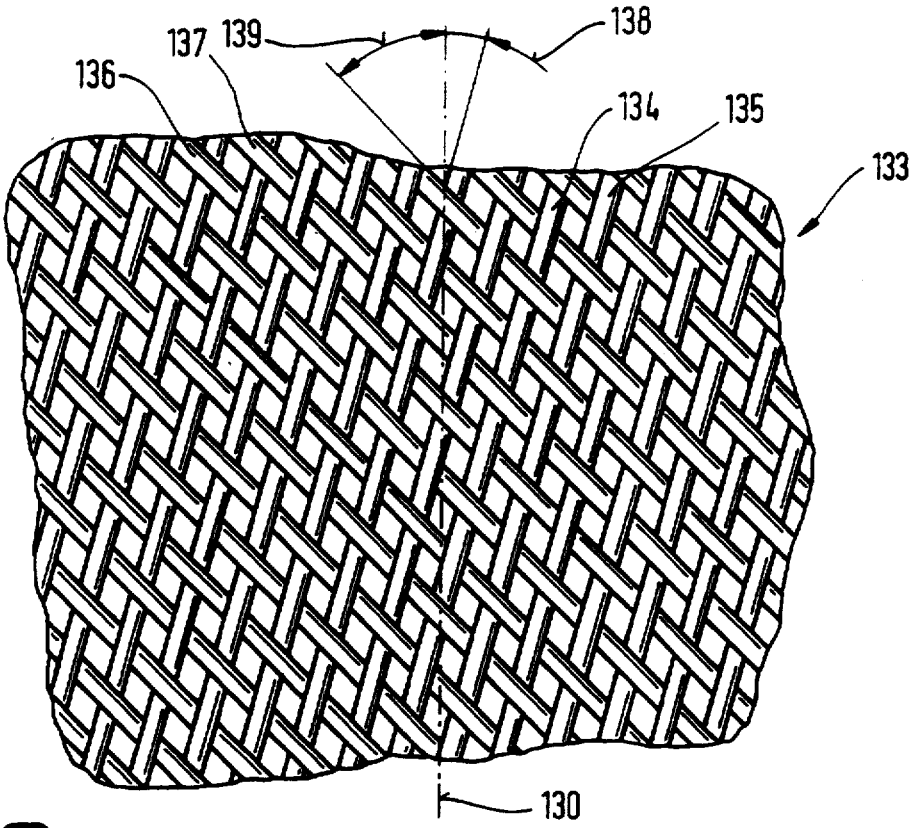
FIG. 22 is a top view of and section along the lines XXII—XXII in FIG. 20 through the other ply of the reinforcement layer.

FIGS. 20 to 22 show an embodiment wherein shell 2 has a reinforcement layer 131 which consists of several plies 132, 133. Each of these plies consists of fibers or threads 124 to 127.

As illustrated, particularly in FIG. 21, the fibers or threads 124 to 127 of ply 132 run symmetrically to longitudinal axis 130 and enclose with the latter an angle 129 of 30°, for example. Angle 128 between these threads 124, 125 and 126, 127 may be, for example, 120°.

In contrast, FIG. 22 shows that threads 134, 135 and 136, 137 of ply 133 may have a different angle 138, 139 to the longitudinal axis 130 of ski 1.

This results in an unsymmetrical reinforcement profile of shell 2 since the different stress-resistant properties caused by the orientation of threads 136, 137 and 134, 135 towards longitudinal axis 130, especially threads 136, 137 which permit a stiffening of shell 2 before ski 1 is finished, in particular also because they run in the direction transverse to longitudinal axis 130, whereas, also when the ski is finished, threads 134, 135 have a stronger effect on the deformation properties of the ski since those threads are running at a smaller angle towards longitudinal axis 130 and, therefore, act as a sort of tension bands while the ski is being bent.

Figure 23:
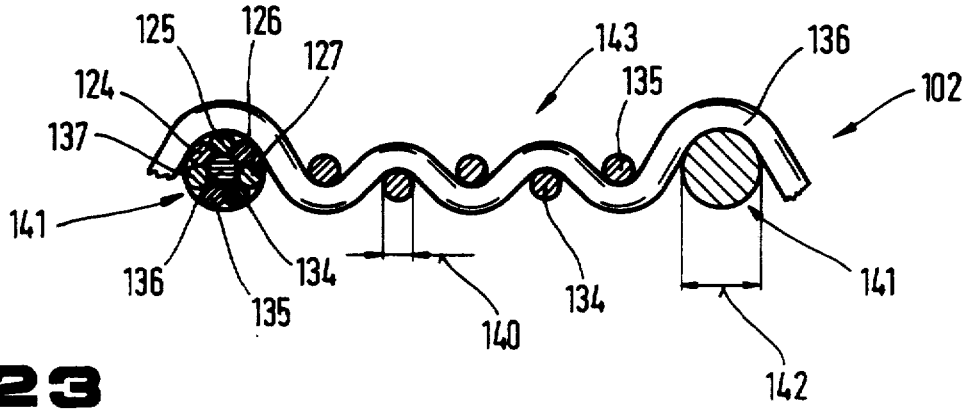
FIG. 23 is a sectional front view of another embodiment of a reinforcement layer.

FIG. 23 shows that individual threads 124 to 127 and 134 to 137 have a smaller diameter 140 than, for example, threads or tension bands 141, formed by several threads or bands, which have a diameter 142. This allows for the formation of caverns 143 between these tension bands 141 which, after reinforcement layer 102 has been applied to cover ply 101, form a hollow space which can take up a bonding agent, such as a liquid plastic material 119, by means of which reinforcement layer 102 can be connected with cover ply 101.

It is, of course, also possible that these tension bands 141 are produced, for example, in the form of ropes from individual fibers or threads 124 to 127 and 134 to 137.

These reinforcement layers 102 can also be produced from several plies, as shown, for example, in FIG. 20 hereabove.

In addition, the position of the angle of the individual fibers or threads 124 to 127 and 134 to 137 may also be different, especially also symmetrical or asymmetrical in relation to longitudinal axis 130. The materials of the individual fibers or threads may also be the same in each ply 132, 133 and reinforcement layer 102, 131 or, optionally, also systematically different in bundles.

Due to the reinforcement of the shell, in particular by the fibers or threads 124 to 127 and 134 to 137 running angularly to longitudinal axis 130 and tension bands 141, the inherent stiffness and dimensional stability of shell 2 is increased, in particular before ski core 6 has been inserted and running surface layer 5 or bottom strap 4 has been applied.

It is, therefore, possible that the shells, even after they have been stacked up for a longer period of time during storage, as indicated schematically in FIG. 18, when they are put into a mold 144, for example bottom part 145 of the mold, will lie non-distorted in die cavity 146. Therefore, no additional holding fixtures or partial vacuum suction devices or similar devices are required to affix shell 2 to bottom part 145 of the mold, which simplifies the overall assembly of this device and especially shortens the work hours for insertion of the individual parts and the finishing of ski 1.

Furthermore, it facilitates the mounting of top part 147 of the mold and achieves a tight seal between bottom part 145 and top part 147 of the mold, which improves the injection of the plastic material into the hollow spaces between shell 2, ski core 6 and reinforcement layers 102, 131 and prevents the bonding agent, in particular plastic material 119, from leaking out during the joining of the individual components to a ski 1. Any time required for after-treatment, in particular subsequent polishing and lacquering, can thus be diminished, or it is also possible that any subsequent lacquering process can be avoided all together.

Figure 24:
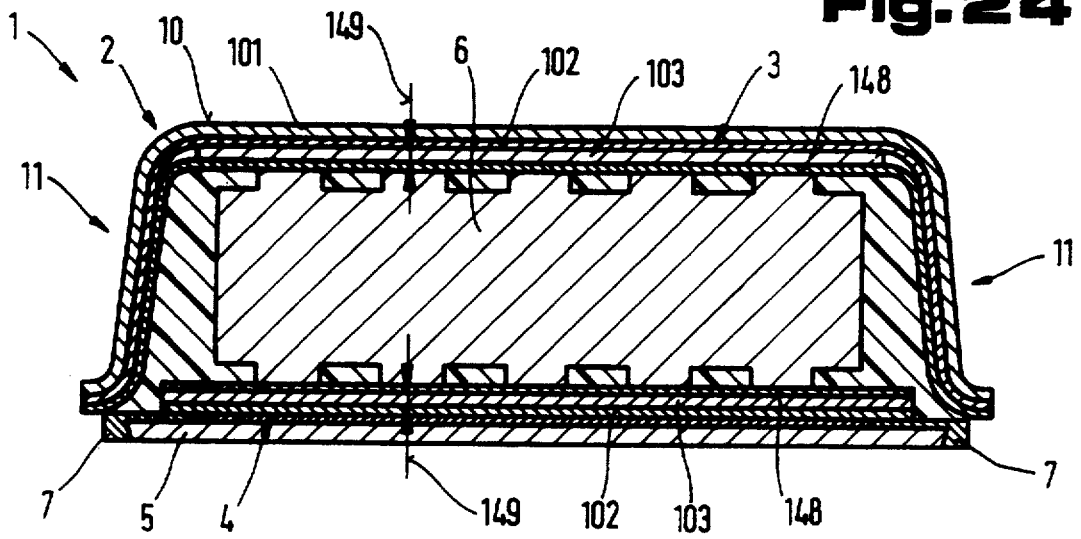
FIG. 24 is a sectional front view of a further embodiment of the ski in accordance with the invention with additional intermediate layers arranged between the reinforcement layers in the top and bottom strap.

FIG. 24 shows another embodiment of a ski 1 with a shell 2 in accordance with the invention.

In this embodiment, the shell consists of a cover ply 101 on which, on the side facing towards ski core 6, a reinforcement layer 102 is arranged. Between this reinforcement layer 102 and ski core 6 in the direction of ski core 6, an intermediate layer 103 and a further reinforcement layer 148 are arranged.

Reinforcement layer 102 and reinforcement layer 148 extend along the base of shell 2 of ski 1 that forms surface 10 and side faces 11 to running edges 7. A bottom strap 4 of this ski 1 consists also of a reinforcement layer 102, an intermediate layer 103 and a further reinforcement layer 148. Bottom strap 4 forms, therefore, a sandwich strap whose structure corresponds to the structure of top strap 3 in the region of surface 10. Preferably, thicknesses 149 of intermediate layers 103 in top strap 3 and bottom strap 4 are equal, and the stress-resistant properties of reinforcement layers 102, 148 in top strap 3 and bottom strap 4 correspond to each other.

Reinforcement layers 102 and 148 consist of intersecting threads or fibers. At least in one of reinforcement layers 102, 148, the threads are arranged diagonally to a longitudinal axis 130 of surface 10 of shell 2.

FIGS. 25 to 28 show different arrangement possibilities for the individual threads or fibers of reinforcement layers 102, 113, 131 and 148 in relation to longitudinal axis 130 of ski 1.

Figure 25:
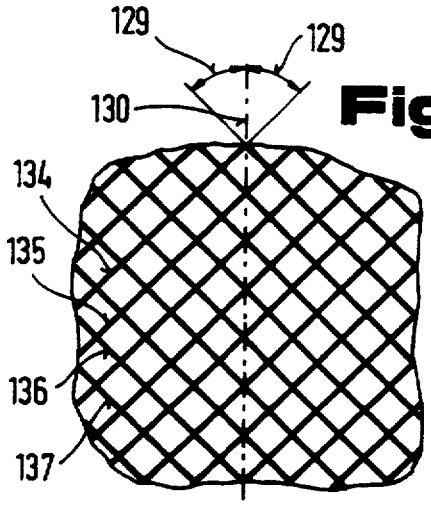
FIG. 25 is a top view of a part of the reinforcement layer with schematically indicated threads or fibers.

As can be seen in FIG. 25, fibers or threads 134 to 137 enclose an angle 129 with longitudinal axis 130. Angle 129 is the same for threads 134, 135 and 136, 137, for example 45°. In general, it can be between 10° and 80°.

Figure 26:
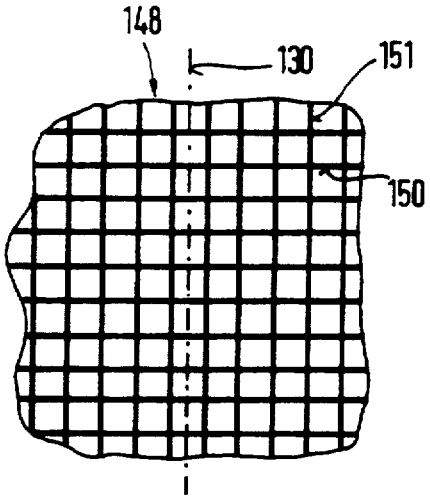
FIG. 26 is a top view of another arrangement of threads or fibers in the reinforcement layer.

As illustrated in FIG. 26, the direction or course of fibers or threads 150, 151 is selected in such a way that threads 150, for example, run perpendicular to longitudinal axis 130 of shell 2.

Figure 27:
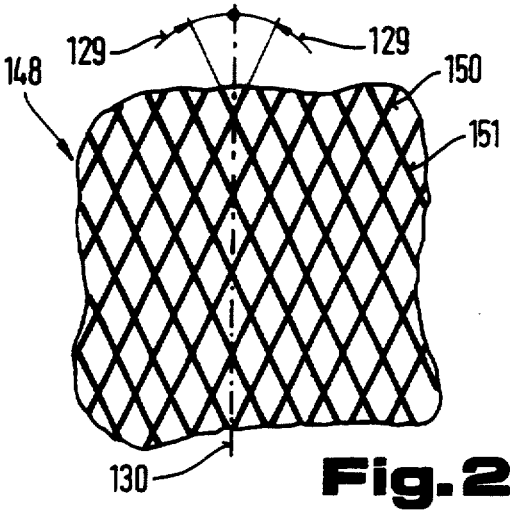
FIG. 27 is a top view of another embodiment for the arrangement of threads or fibers in the reinforcement layer.

It is, however, as shown in FIG. 27, also possible that threads 150, 151 run diagonally towards longitudinal axis 130, and angle 129 between threads 150, 151 or longitudinal axis 130 can also be smaller than 45°, for example between 10° and 30°.

In this connection, it is, of course, also possible that reinforcement layers 102, 148 in top or bottom straps 3, 4 can be differently formed with regard to the course of threads 150, 151.

Figure 28:
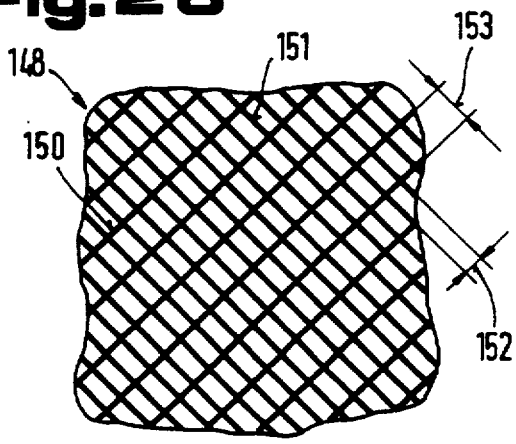
FIG. 28 is a top view of another arrangement of threads or fibers in the reinforcement layer.

As seen in FIG. 28, it is, therefore, also possible that reinforcement layer 148 or, for example, also reinforcement layer 102 or 131, is formed from threads 150 and 151, and threads 151 are arranged at a shorter distance 152 than threads 150 where distance 153 between them is greater.

Figure 29:
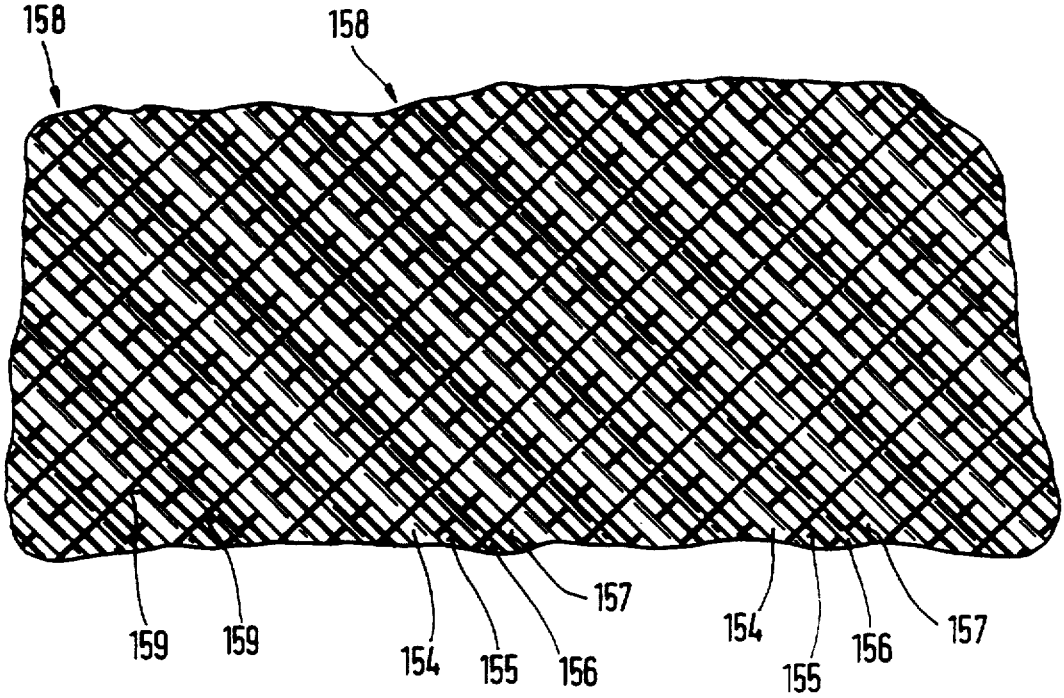
FIG. 29 is a further embodiment for threads or fibers arranged in groups for a reinforcement layer.

FIG. 29 shows a further embodiment, wherein a more flexible form of the stress-resistant and elastic properties of reinforcement layers 102, 131, 148 and ski 1 is achieved. This is accomplished by arranging threads 154, 155, 156, 157, for example, in a sequence of like thread groups 158, with threads 159 running transversely thereto, which can all be the same, to form the reinforcement layer. In this case, it is also possible that threads 154 to 157 are from different materials, for example metal, plastic material, ceramics, graphite. To this end, the sequence of the individual threads or the combination of the materials of a thread group 158 can be modified according to the desired purposes ski 1 is used for.

It is, of course, also possible to use different materials for threads 159 that are meshed or interwoven with threads 154 to 157 and to arrange these threads, if desired, in thread groups 158.

These reinforcement layers 102, 112, 131 and 148 can, of course, also consist of any fabric or tissue or lattice. Moreover, it is also possible to form reinforcement layers 102, 112, 131 and 148 according to the embodiment in FIG. 24 in several plies, that is to say with two or more plies.

Finally, it should be pointed out that individual features of the above-described embodiments may be combined in any desired way.

For better understanding of the invention, the individual layers and plies and components of ski 1 have been illustrated partially out of proportion and not true to scale.

What is claimed is:

1. A ski comprising (a) a top strap comprising more than one layer and integrated in a shell of substantially U-shaped cross section, the shell comprising a cover layer and a reinforcement layer, and the shell having
  (1) a base forming the surface of the ski and
  (2) shanks extending downwardly from the base and inclined at an angle with respect thereof, the shanks forming the side faces of the ski, the shanks having ends remote from the base, (b) a bottom strap comprising
  (1) a running surface layer and at least one additional reinforcement layer,
  (2) spacers between the running surface and the additional reinforcement layer,
  (3) running edges extending longitudinally along the two sides of the running surface layer, each running edge abutting the end of a respective one of the shanks along a longitudinally extending line running in a horizontal plane of contact between the running edge and the shank end, and
  (4) the shell and the bottom strap defining an inner hollow space, (c) a ski core arranged in the hollow space, the ski core having
  (1) an upper side facing the top strap,
  (2) a lower side facing the bottom strap and
  (3) side walls spaced from the shanks to define intermediate hollow spaces between the side walls and the inner surfaces of the shell shanks, the intermediate hollow spaces each including a chamber extending in the longitudinal direction of the ski, projecting outwardly and continuously tapering towards an outer face of the running edge and ending at the longitudinally extending line, (d) support elements arranged on the upper and lower core sides, the support elements defining longitudinally and transversely extending recesses therebetween and between the upper and lower core sides and the top and bottom straps, the recesses communicating with the intermediate hollow spaces and the chambers thereof, (e) intermediate layers between the base of the shell and the core, (f) a plastic material filling the recesses and the intermediate hollow spaces including the continuously tapering chambers, the plastic material being bonded to the shell, the core, the top strap and the bottom strap.

2. The ski of claim 1, wherein the plastic material is an elastomer foam.

3. The ski of claim 1, wherein the longitudinally extending line is defined by the intersection of a vertical plane defining the outer face of the running edge and the horizontal plane of contact between the running edge and the end of the shank.

4. The ski of claim 1, wherein the longitudinally extending line is spaced from a vertical plane defining the outer face of the running edge.

5. The ski of claim 1, wherein one of the intermediate hollow spaces has a smaller volume than the other intermediate hollow space.

6. The ski of claim 1, wherein the intermediate hollow spaces have a cross-sectional area varying in the longitudinal direction of the ski in proportion to the cross-sectional area of the ski or the core.

7. The ski of claim 6, wherein the ski has a leading end, a rear end and a central region therebetween, and the cross-sectional area of the intermediate hollow spaces is smaller in the central region than at the ends of the ski.

8. The ski of claim 7, wherein the side walls of the core enclose an angle with the bottom strap which decreases from the central region to the ends of the ski.

9. The ski of claim 1, wherein the side walls of the core and the shanks of the shell extend substantially parallel to each other.

10. The ski of claim 1, wherein the shanks of the shell are oriented at a larger inner angle with respect to the base of the shell than at least one of the side walls of the core.

11. The ski of claim 10, wherein the larger inner angle between 70° and 130°, and the smaller inner angle is 90°.

12. The ski of claim 1, wherein the ski has a leading end, a rear end and a central region therebetween, and at least one of the side walls of the core has projections defining depressions therebetween, the projections increasing in height from the center region towards the ends.

13. The ski of claim 1, wherein the ski has a leading end, a rear end and a central region therebetween, and at least one of the shanks of the shell has projections on the inside thereof and defining depressions therebetween, the projections increasing in height from the center region towards the ends.

14. The ski of claim 1, wherein the plastic material filling the intermediate hollow spaces is a two-component polyurethane elastomer foam.

15. The ski of claim 1, further comprising projections extending from the running edges towards the top strap, the projections being spaced inwardly from the outer faces of the running edges by a distance corresponding at least to the thickness of the shanks of the shell.

16. The ski of claim 1, further comprising a sandwich structure comprised of a laminate, an aluminum layer and another laminate arranged between the running surface layer and the core, and a spacing insert between the running surface layer and the core, the spacing insert having a thickness corresponding to the thickness of an inwardly extending flange of the running edges.

17. The ski of claim 1, wherein the reinforcement layer of the shell is comprised of at least one pre-impregnated fiber reinforced ply, the fibers intersecting each other and extending obliquely with respect to a longitudinal axis of the shell base.

18. The ski of claim 17, wherein the fibers are of a tension-resistant material.

19. The ski of claim 17, comprising a plurality of said plies, the intersecting fibers enclosing angles which differ from ply to ply.

20. The ski of claim 19, comprising two of said plies, the intersecting fibers enclosing angles between 45° and 90°.

21. The ski of claim 17, wherein the fibers are arranged in bundles and are made of different materials.

22. The ski of claim 17, wherein the reinforcement layer extending over the base and shanks of the shell is of a single piece.

23. The ski of claim 17, wherein the fibers are combined in fiber groups, the fibers of the groups being made of different materials.

24. The ski of claim 17, wherein the fiber-reinforced ply is pre-impregnated with a temperature and pressure-sensitive bonding agent which is non-adhesive at room temperature.

25. A ski having a leading end, a rear end and a central region, the ski comprising (a) a top strap comprising more than one layer and integrated in a shell of substantially U-shaped cross section, the shell comprising a cover layer and a reinforcement layer, and the shell having
  (1) a base forming the surface of the ski and
  (2) shanks extending downwardly from the base and inclined at an angle with respect thereof, the shanks forming the side faces of the ski, the shanks having ends remote from the base, (b) a bottom strap comprising
  (1) a running surface layer and at least one additional reinforcement layer,
  (2) running edges extending longitudinally along the two sides of the running surface layer, each running edge abutting the end of a respective one of the shanks along a longitudinally extending line running in a horizontal plane of contact between the running edge and the shank end, and
  (3) the shell and the bottom strap defining an inner hollow space, (c) a ski core arranged in the hollow space, the ski core having
  (1) an upper side facing the top strap,
  (2) a lower side facing the bottom strap and
  (3) side walls spaced from the shanks to define intermediate hollow spaces between the side walls and the inner surfaces of the shell shanks, the intermediate hollow spaces each including a chamber extending in the longitudinal direction of the ski, projecting outwardly and continuously tapering towards an outer face of the running edge and ending at the longitudinally extending line, (d) support elements arranged on the upper and lower core sides, the support elements being arrayed on the upper side of the core only alongside the side walls of the core in the central region, leaving a central area of the upper core side free of support elements, the support elements defining longitudinally and transversely extending recesses therebetween and between the upper and lower core sides and the top and bottom straps, the recesses communicating with the intermediate hollow spaces and the chambers thereof, (e) intermediate layers between the base of the shell and the core, (f) a plastic material filling the recesses and the intermediate hollow spaces including the continuously tapering chambers, the plastic material being bonded to the shell, the core, the top strap and the bottom strap, (g) an anchoring plate spanning the central area of the upper core side, (h) a ski binding mounted on the surface of the ski, and (i) fastening elements in the region of the side walls of the core connecting the ski binding to the anchoring plate.

26. The ski of claim 25, wherein the anchoring plate is made of spring steel.

27. The ski of claim 25, wherein the spaces between central area of the upper core side and the anchoring plate and the anchoring plate and the top strap are filled with a plastic material of a hardness less than the hardness of the plastic material filling the intermediate hollow spaces.

28. The ski of claim 27, wherein the plastic material of less hardness forms a gel whose hardness varies under the influence of energy and temperature changes.

* * * * *